US005909162A

United States Patent [19]

Ikeda et al.

[11] Patent Number: 5,909,162

[45] Date of Patent: Jun. 1, 1999

[54] SEESAW TYPE ELECTROMAGNETIC RELAY SERVING AS A CONTINUOUS CONTACT WITH A LOW POWER CONSUMPTION

[75] Inventors: Matsujiro Ikeda; Kazuya Yamakosi, both of Tokyo, Japan

[73] Assignee: NEC Corporation, Japan

[21] Appl. No.: 08/803,242

[22] Filed: Feb. 20, 1997

[30] Foreign Application Priority Data

Feb. 20, 1996 [JP] Japan ..... 8-031854

[51] Int. Cl.[6] ..... H01H 51/22

[52] U.S. Cl. ..... 335/78; 335/128; 335/83; 335/125; 335/129; 335/133

[58] Field of Search ..... 335/78, 128, 79–86, 335/135, 125, 194, 129

[56] References Cited

U.S. PATENT DOCUMENTS

| | | | |
|---|---|---|---|
| 5,304,970 | 4/1994 | Okamoto et al. | 335/78 |
| 5,337,029 | 8/1994 | Nobutoki et al. | 335/78 |
| 5,608,366 | 3/1997 | Sako | 335/78 |

FOREIGN PATENT DOCUMENTS

| | | |
|---|---|---|
| 60-168243 | 8/1985 | Japan . |
| 60-168243 | 11/1985 | Japan . |
| 2-18246 | 2/1990 | Japan . |
| 3-222230 | 10/1991 | Japan . |
| 4-78720 | 7/1992 | Japan . |

*Primary Examiner*—Lincoln Donovan
*Assistant Examiner*—Tuyen T. Nguyen
*Attorney, Agent, or Firm*—Ostrolenk, Faber, Gerb & Soffen, LLP

[57] ABSTRACT

In a seesaw type electromagnetic relay comprising an armature carrying out a seesaw motion by excitation of an electromagnet, and a movable spring which carries out the seesaw motion in synchronism with the seesaw motion of the armature and which comprises a par of spring sections, at least one of the spring sections forks into two branches to form a pair of spring pieces one of which is bent downward. A pair of movable contacts is mounted at both free end parts of the movable spring on a bottom surface of the movable spring. One of the movable contacts is mounted at the free end part in the spring pieces on bottom surfaces thereof to form a pair of movable contact elements acting as a twin movable contact. A pair of fixed contacts faces the pair of movable contacts. In an open state, a distance between one of the movable contact elements in the twin movable contact and the fixed contact opposed to the twin movable contact is different from another distance between another of the movable contact elements in the twin movable contact and the fixed contact opposed to the twin movable contact. The fixed contact opposed to the twin movable contact may consist of a twin fixed contact having a difference in level.

6 Claims, 19 Drawing Sheets

46-1
46-2
CLOSE
OPEN 47-1
47-2
CLOSE
OPEN

MAKE CONTACT
CLOSE
OPEN

BREAK CONTACT
CLOSE
OPEN (a)
(b')
(c')
(d)
TIME 46-1
46-2
CLOSE
OPEN 47-1
47-2
CLOSE
OPEN

MAKE CONTACT
CLOSE
OPEN

BREAK CONTACT
CLOSE
OPEN
(a)
(b)
(c)
(d)
TIME 46-1
CLOSE
OPEN 46-2
CLOSE
OPEN 47-1
47-2
CLOSE
OPEN

MAKE CONTACT
CLOSE
OPEN

BREAK CONTACT
CLOSE
OPEN
(a)
(b)
(c)
(c')
(d)
TIME 46-1
CLOSE
OPEN 46-2
CLOSE
OPEN 47-1
CLOSE
OPEN 47-2
CLOSE
OPEN
FIG. 17E MAKE CONTACT
CLOSE
OPEN
FIG. 17F BREAK CONTACT
CLOSE
OPEN
(a) (b') (b) (c) (c') (d)
TIME

SEESAW TYPE ELECTROMAGNETIC RELAY SERVING AS A CONTINUOUS CONTACT WITH A LOW POWER CONSUMPTION

BACKGROUND OF THE INVENTION

This invention relates to an electromagnetic relay and, more particularly, to a seesaw type electromagnetic relay serving as a continuous contact.

A seesaw type electromagnetic relay of the type is disclosed as prior art in Japanese Unexamined Patent Prepublication of Tokkai No. Hei 3-222,230, namely, 222,230/1991. According to Tokkai No. Hei 3 222,230, the seesaw type electromagnetic relay is symmetrical in shape for an armature. The armature comprises a central part rotatably supported on a supporting point and a pair of armature arm parts which extends from the central part in opposite directions. The armature makes a seesaw motion by excitation of an electromagnet. The armature is supported by a supporting member at the central part. The seesaw type electromagnetic relay comprises a pair of movable springs which extend to a direction in parallel with the armature with spaces left therebetween. Each movable spring comprises a middle part fixed to the supporting member and a pair of spring sections extending in parallel with both armature arm parts. The middle part of the movable spring is always in electrically contact with a common contact.

Each spring section forks into two branches to form a pair of spring pieces. The spring pieces have two free end parts on which two movable contact elements are mounted. The two movable contact elements are collectively called a twin movable contact. Each twin movable contacts faces a fixed contact. For each movable spring, a set of one twin movable contact and one fixed contact serves as a make contact while another set of another twin movable contact and another fixed contact acts as a break contact.

The seesaw type electromagnetic relay is operable as either a transfer contact or a continuous contact. The transfer contact is a contact where the break contact opens before the make contact closes. The continuous contact is a contact where the make contact closes before the break contact opens. The continuous contact is also called a make-before-break contact.

In a case of making the conventional seesaw type electromagnetic relay operable as the continuous contact, both spring sections in each movable spring are bent downward. As a result, the seesaw type electromagnetic relay has stronger maximum load force and it results in requiring large load energy upon driving of the continuous contact. As a result, there is little margin for a matching between magnetic attraction force of the electromagnet and urging force of an urging spring. In addition, the conventional seesaw type electromagnetic relay serving as the continuous relay consumes large power upon driving of it.

Various other electromagnetic relays have already proposed in, for example, Japanese Unexamined Utility Model Prepublication or Jikkai Nos. Sho 60-168,243, Hei 2-18,246, and Hei 4-78,720. Those Prepublications disclose the electromagnetic relays where a distance between an movable contact element of a twin movable contact and a fixed contact is different from a distance between another movable contact element of the twin movable contact and the fixed contact. However, all of the Prepublications only disclose the electromagnetic relays each of which acts as the make contact.

SUMMARY OF THE INVENTION

It is therefore an object of this invention to provide a seesaw type electromagnetic relay serving as a continuous contact, which is capable of reducing load energy upon driving of it.

It is another object of this invention to provide a seesaw type electromagnetic relay of the type described, which has a gentle load characteristic.

It is still another object of this invention to provide a seesaw type electromagnetic relay of the type described, wherein there is much margin for a matching between magnetic attraction force of an electromagnet and urging force of an urging spring.

It is yet another object of this invention to provide a seesaw type electromagnetic relay of the type described, which is capable of decreasing power consumption upon driving of it.

Other objects of this invention will become clear as the description proceeds.

According to this invention, a seesaw type electromagnetic relay comprises an armature comprising a central part rotatably supported on a supporting point and a pair of armature arm parts which extend from the central part in opposite directions to make seesaw motion by excitation of an electromagnet. A supporting member supports the armature at the central part. A movable spring comprises a middle part fixed to the supporting member and a pair of spring sections which extend in parallel with the both armature arm parts. At least one of the spring sections forks into two branches to form a pair of spring pieces. The movable spring has both free end parts. The movable spring carries out the seesaw motion in synchronism with the seesaw motion of the armature. A pair of movable contacts is mounted on the both free end parts of the movable spring at a bottom surface of the movable spring. One of the movable contacts is mounted on the free end part in the spring pieces to form a pair of movable contact elements which acts as a twin movable contact. A pair of fixed contacts face the pair of movable contacts. A distance between one of the movable contact elements and the fixed contact opposed to the twin movable contact is different from a distance between another of the movable contact elements and the fixed contact opposed to the twin movable contact. The seesaw type electromagnetic relay serves as a continuous contact.

BRIEF DESCRIPTION OF THE DRAWING

FIGS. 17A through 17F collectively show a time chart for use in describing operation of the seesaw type electromagnetic relay illustrated in FIG. 15;

DESCRIPTION OF THE PREFERRED EMBODIMENTS

Figure 1:
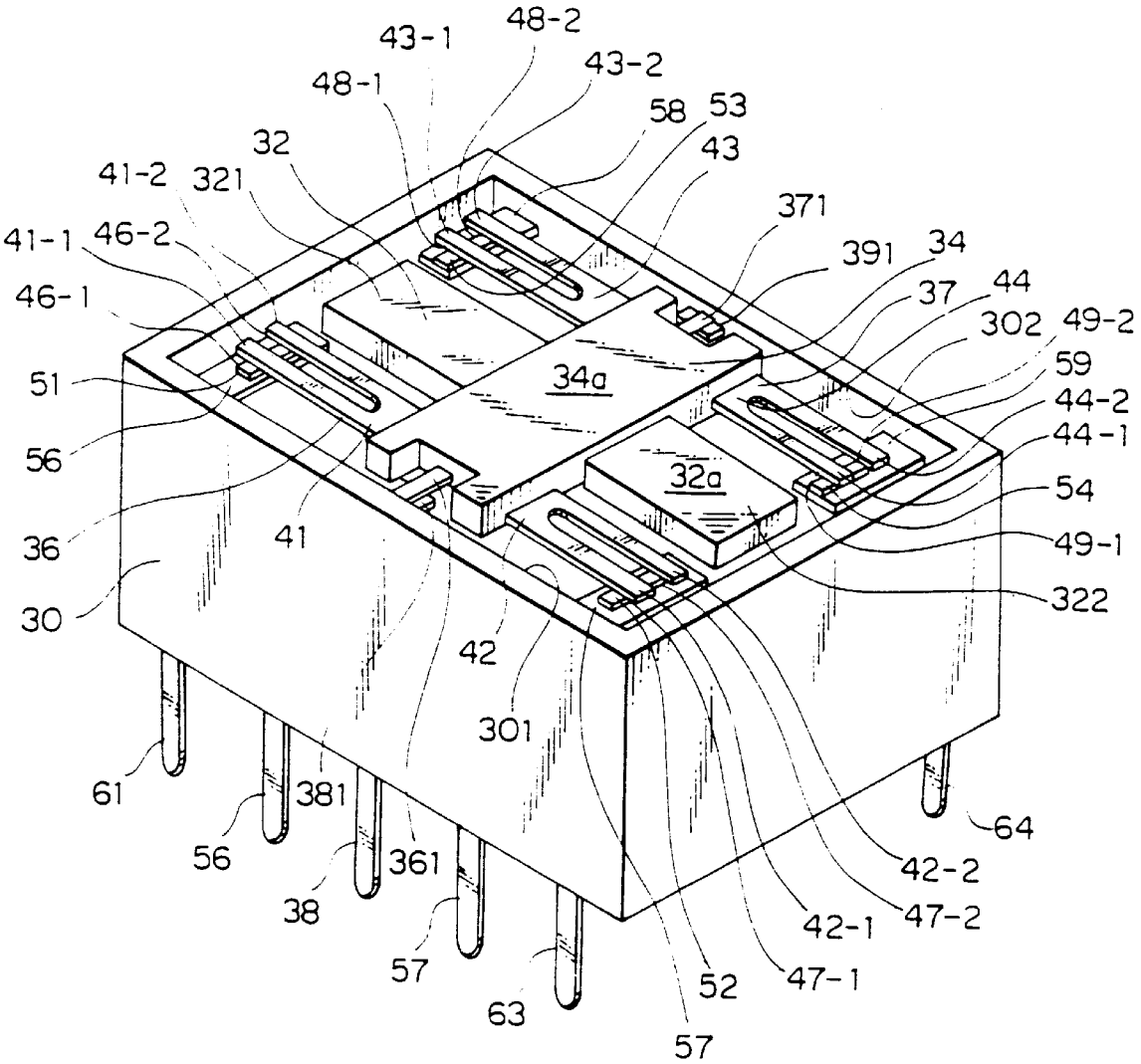
FIG. 1 PRIOR ART
FIG. 1 is a perspective view of a conventional seesaw type electromagnetic relay.

Referring to FIG. 1, a conventional seesaw type electromagnetic relay will be described in order to facilitate an understanding of the present invention. The illustrated seesaw type electromagnetic relay is disclosed as prior art in the above-mentioned Japanese Unexamined Patent Prepublication of Tokkai No. Hei 3-222,230 (222,230/1991) and comprises a housing 30 for receiving an electromagnet (not shown) therein. The housing 30 is made of an insulating material such as synthetic resin. The housing 30 is box in configuration having an opening at an upper side thereof. The electromagnet is disposed in the housing 30 at the opening side. The housing 30 includes a central part which will later become clear. The central part serves as a supporting point for supporting an armature 32 at a middle part thereof. In other words, the armature 32 is supported on the central part of the housing 30 so as to make the armature 32 carry out a seesaw motion. The armature 32 has a main surface 32*a*. The armature 32 consists of first and second armature arm parts 321 and 322 which extend from the middle part thereof in opposite directions to make the armature 32 carry out the seesaw motion by excitation of the electromagnet.

The armature 32 is made of a magnetic material such as soft magnetic iron and is a flat plate in shape. The armature 32 is supported by a supporting member 34 at the middle part thereof. The supporting member 34 has a main surface 34*a*. The supporting member 34 is made of an insulating material such as synthetic region. In other words, the supporting member 34 covers the armature 32 at the middle part thereof and extends in a direction perpendicular to the armature 32.

The illustrated seesaw type electromagnetic relay is symmetrical in shape with the armature 32 and has two poles which will later become clear. The seesaw type electromagnetic relay further comprises first and second movable springs 36 and 37 which extend to in directions parallel with the armature 32 with spaces left therebetween. Each of the first and the second movable springs 36 and 37 is made of a spring member such as phosphor bronze or the like. Each of the first and the second movable springs 36 and 37 has a spring middle part which is covered by the supporting member 34. In other words, the first and the second movable springs 36 and 37 penetrate the supporting member 34. The first and the second movable springs 36 and 37 comprise first and second coupling pieces 361 and 371 which project from a spring middle part thereof at both ends of the supporting member 34 in a direction perpendicular to the armature 32. Each of the first and the second coupling pieces 361 and 371 is a rod in shape. The first and the second coupling pieces 361 and 371 serve as axis of rotation for rotating the armature 32 to make the armature 32 carry out the seesaw motion about the axis of rotation.

The first coupling piece 361 of the first movable spring 36 is rotatably mounted on a first common contact 381 to be always in electrically contact with the first common contact 381. The first common contact 381 is mounted on a first common terminal strip 38 which extends downward along an inner side wall 301 of the housing 30 to project into outside of the housing 30. Similarly, the second coupling piece 371 of the second movable spring 37 is rotatably mounted on a second common contact 391 to be always in electrically contact with the second common contact 391. The second common contact 391 is mounted on a second common terminal plate (not shown) which extends downward along an opposite inner side wall 302 of the housing 30 to project into outside of the housing 30.

The first movable spring 36 comprises first and second spring sections 41 and 42 which extend from the middle part thereof in opposite directions in parallel with the armature 32. Similarly, the second movable spring 37 comprises third and fourth spring sections 43 and 44 which extend from the middle part thereof in opposite directions in parallel with the armature 32. As a result, when the armature 32 carries out the seesaw motion by excitation of the electromagnet, the first through the fourth spring sections 41 to 44 also carry out the seesaw motion.

Each of the first through the fourth spring sections 41 to 44 has U-shaped or fork-shaped. More specifically, the first spring section 41 forks into two branches to form first and second spring pieces 41-1 and 41-2. Likewise, the second spring section 42 forks into two branches to form third and fourth spring pieces 42-1 and 42 2. The third spring section 43 forks into two branches to form fifth and sixth spring pieces 43-1 and 43-2. Likewise, the fourth spring section 44 forks into two branches to form seventh and eighth spring pieces 44-1 and 44-2.

The first and the second spring pieces 41-1 and 41-2 of the first spring section 41 have first and second free end parts at which first and second movable contact elements 46-1 and 46-2 are mounted on a bottom surface of the first spring section 41, respectively. Similarly, the third and the fourth spring pieces 42-1 and 42-2 of the second spring section 42 have third and fourth free end parts at which third and fourth movable contact elements 47-1 and 47-2 are mounted on a bottom surface of the second spring section 42, respectively. The fifth and the sixth spring pieces 43-1 and 43-2 of the third spring section 43 have fifth and sixth free end parts at which fifth and sixth movable contact elements 48-1 and 48-2 are mounted on a bottom surface of the third spring section 43, respectively. The seventh and the eighth spring pieces 44-1 and 44-2 of the fourth spring section 44 have seventh and eighth free end parts on which seventh and eighth movable contact elements 49-1 and 49-2 are mounted on a bottom surface of the fourth spring section 44. The first and the second movable contact elements 46-1 and 46-2 are collectively called a first twin movable contact. Likewise, the third and the fourth movable contact elements 47-1 and 47-2 are collectively called a second twin movable contact. The fifth and sixth movable contact elements 48-1 and 48-2 are collectively called a third twin movable contact. The seventh and the eighth movable contact elements 49-1 and 49-2 are collectively called a fourth twin movable contact.

The first through the fourth twin movable contacts face first through fourth fixed contacts 51, 52, 53, and 54, respectively. The first through the fourth fixed contacts 51 to 54 are mounted on first through fourth fixed terminal strips 56, 57, 58, and 59, respectively. The first and the second fixed terminal strips 56 and 57 extend downward along the inner side wall 301 of the housing 30 to project into outside of the housing 30. Likewise, the third and the fourth fixed terminal strips 58 and 59 extend downward along the opposite inner side wall 302 of the housing 30 to project into outside of the housing 30.

The seesaw type electromagnetic relay further comprises a first coil terminal strip 61 and a second coil terminal strip (not shown). The first coil terminal strip 61 extends downward along the inner side wall 301 of the housing 30 to project outside of the housing 30 from a base (not shown) of the housing 30 while the second coil terminal strip 62 extends downward along the opposite inner side wall 302 of the housing 30 to project outside of the housing 30 from the base of the housing 30. The electromagnet includes a coil (not shown) having a pair of winding ends connected to the first coil terminal strip 61 and the second coil terminal strip. As shown in FIG. 1, the seesaw type electromagnetic relay further may comprise a third coil terminal strip 63 and a fourth coil terminal strip 64. The third coil terminal strip 63 extends downward along the inner side wall 301 of the housing 30 to project outside of the housing 30 from the base of the housing 30 while the fourth coil terminal strip 64 extends downward along the opposite inner side wall 302 of the housing 30 to project outside of the housing 30 from the base of the housing 30. In this event, the electromagnet may include another coil having a pair of winding ends connected to the third coil terminal strip 63 and to the fourth coil terminal strip 64.

The first common terminal strip 38, the first and the second fixed terminal strips 56 and 57, and the first and the third coil terminal strips 61 and 63 are arranged in a single column with an equivalent pitch at the base of the housing 30. Likewise, the second common terminal strip, the third and the fourth fixed terminal strips 58 and 59, the second coil terminal strip, and the fourth coil terminal strip 64 are arranged in another single column with the equivalent pitch at the base of the housing 30.

Figure 2A:
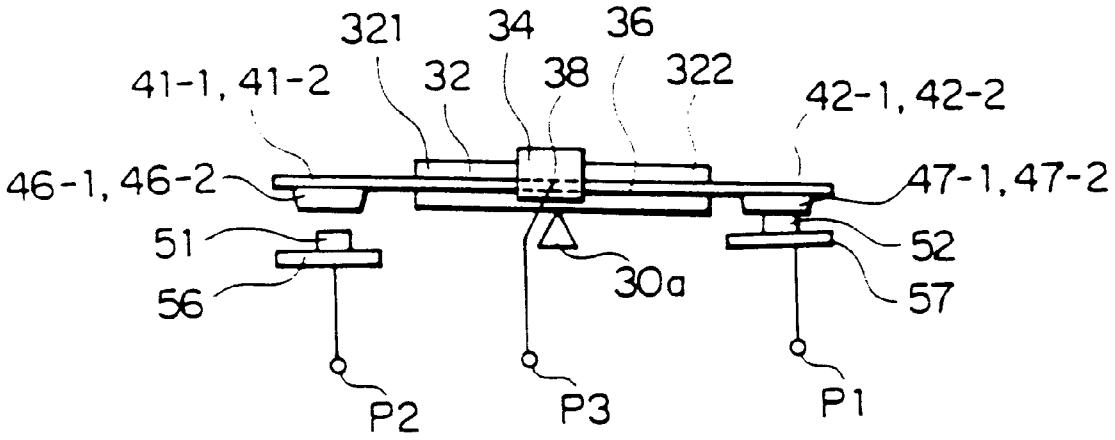
FIG. 2A PRIOR ART
FIGS. 2A and 2B show schematic front views for use in describing operation of the conventional seesaw type electromagnetic relay illustrated in FIG. 1.
Figure 2B:
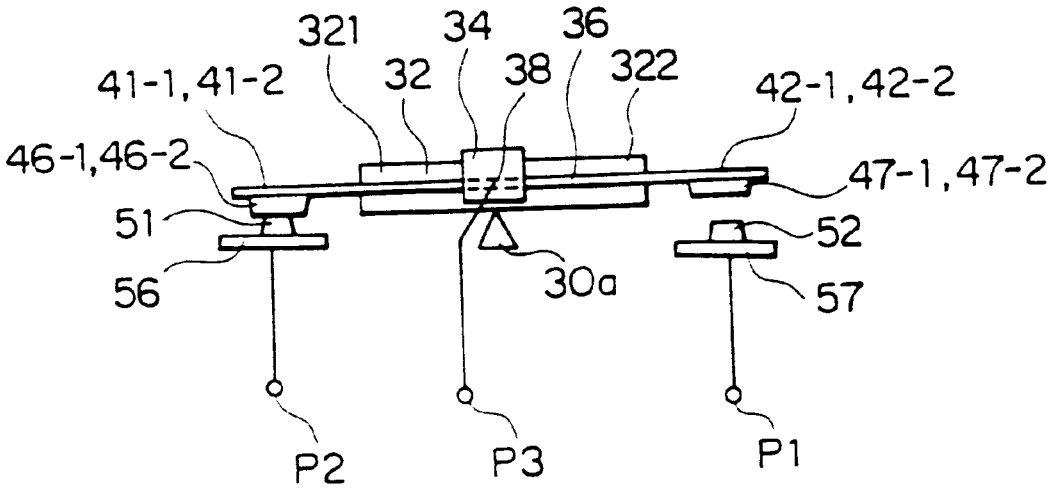
FIG. 2B PRIOR ART

Turning to FIGS. 2A and 2B, description will be made as regards operation of the conventional seesaw type electromagnetic relay illustrated in FIG. 1. FIG. 2A shows a state where the electromagnet is not excited while FIG. 2B shows a state where the electromagnet is excited. In FIGS. 2A and 2B, symbols P1, P2, and P3 indicate first through third points in an external circuit (not shown). The first point P1 is electrically connected to the second fixed terminal strip 57 while the second point P2 is electrically connected to the first fixed terminal strip 56. The third point P3 is electrically connected to the first common terminal strip 38. Inasmuch as the seesaw type electromagnetic relay is symmetrical in shape with the armature 32, the description will therefore be made as regards only one pole side.

It is assumed that the seesaw type electromagnetic relay has an angular displacement θ of zero when the main surface 32*a* of the armature 32 or the main surface 43*a* of the supporting member 34 is level. When the main surface 32*a* of the armature 32 (the main surface 34*a* of the supporting member 34) inclines to the right or when the armature 32 rotates in a clockwise direction on the basis of level, the angular displacement θ is negative. In other words, the angular displacement θ is negative when the second armature arm part 322 has a height lower than that of the first armature arm part 321. When the main surface 32*a* of the armature 32 (the main surface 34*a* of the supporting member 34) inclines to the left or when the armature 32 rotates in a counterclockwise direction on the basis of level, the angular displacement θ is positive. In other words, the angular displacement θ is positive when the first armature arm part 321 is a height lower than that of the second armature arm part 322.

When the electromagnet is not excited, it is assumed that the armature 32 is urged by an urging spring (not shown) to rotate in a clockwise direction. That is, the seesaw type electromagnetic relay has the angular displacement θ of negative. As a result, the first twin movable contact (or the first and the second movable contact elements or 46-1 and 46-2) is open or separated from the first fixed contact 51 while the second twin movable contact (the second pair of movable contact elements 47-1 and 47-2) is closed or in contact with the second fixed contact 52 as shown in FIG. 2A. Under these circumstances, a two-point contact is made between the first and the third points P1 and P3.

Accordingly, in the example being illustrated, a combination of the first twin movable contact 46-1 and 46-2 and the first fixed contact 51 serves as a make contact while a combination of the second twin movable contact 47-1 and 47-2 and the second fixed contact 52 acts as a break contact. Each of the first and the second spring pieces 41-1 and 41 2 of the first spring section 41 is herein called a make spring while each of the third and the fourth spring pieces 42-1 and 42-2 of the second spring section 42 is herein called a break spring.

When the electromagnet is excited, the electromagnet magnetically attracts the first armature arm part 321 of the armature 32 causing, the armature 32 to carries out the seesaw motion with the central part 30*a* as the supporting point in the manner described above. As a result, the seesaw type electromagnetic relay has the angular displacement θ of positive. Accordingly, the first movable spring 36 also rotates in the counterclockwise direction to be placed into the state illustrated in FIG. 2B. That is, the first twin movable contact (the first and the second movable contact elements 46-1 and 46-2) closes (is in contact with) the fist fixed contact 51 while the second twin movable contact (the third and the fourth movable contact elements 47-1 and 47-2) opens (separates from the second fixed contact 52). At this time, a two-point contact is made between the second and the third points P2 and P3 as shown in FIG. 2B.

As is well known in the art, there are contacts of various types. One type of contact is called a transfer contact. The transfer contact is a contact where the break contact opens before the make contact closes. There is no condition when the movable contacts are simultaneously closed. A second type of contact is called a continuous contact. The continuous contact is a contact where the make contact closes before the break contact opens. There is no condition in which both pairs of movable contacts are open simultaneously. The continuous contact is also called a make-before-break contact.

The above-mentioned conventional seesaw type electromagnetic relay can be operated as either a transfer contact or a continuous contact. In a case of making the conventional seesaw type electromagnetic relay operable as the transfer contact, each of the first and the second movable springs 36 and 37 is formed in substantially flat shape (i.e., planar) so that there is a state where the first and the second twin movable contacts are open simultaneously and the third and the fourth twin movable contacts are open simultaneously. Alternatively, the first and the second spring sections 41 and 42 of the first movable spring 36 and the third and fourth spring sections 43 and 44 of the second movable spring 37 are bent downward so that there is a state where the first and the second twin movable contacts close simultaneously and the third and the fourth twin movable contacts close simultaneously.

Turning to FIGS. 3A through 3D and FIGS. 4A through 4D, the operation of the conventional seesaw type electromagnetic relay illustrated in FIG. 1, operable as the transfer contact, will be described.

Figure 3A:
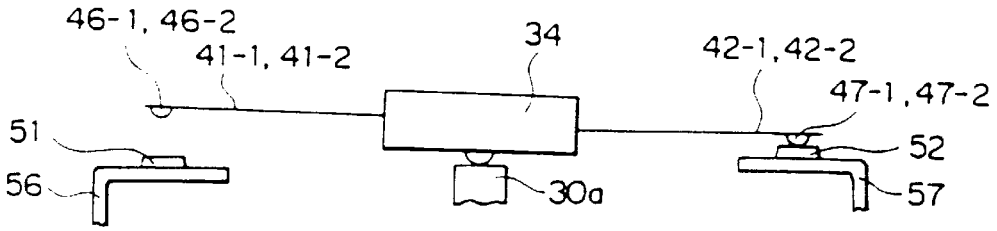
FIG. 3A PRIOR ART
FIGS. 3A through 3D show schematic front views for use in describing operation in a case of making the conventional seesaw type electromagnetic relay illustrated in FIG. 1 operable as a transfer contact.

FIG. 3A shows a state where the electromagnet is not excited. In this state, the make contact (the first and the second movable contact elements 46-1 and 46-2) opens while the break contact (the third and the fourth movable contact elements 47-1 and 47-2) closes as shown at a timing of (a) in FIGS. 4A through 4D. That is, a two-point contact is made between the break contact and the first common contact 381.

Figure 3B:
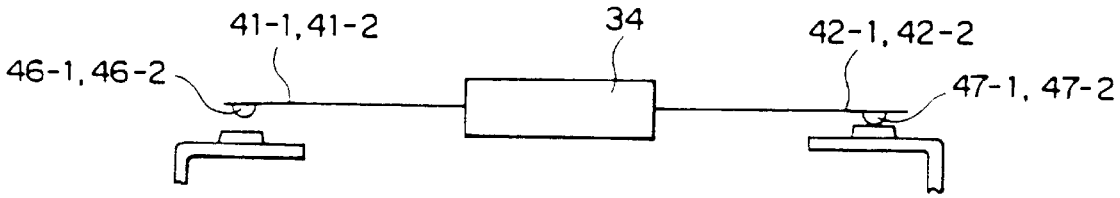
FIG. 3B PRIOR ART
Figure 3C:
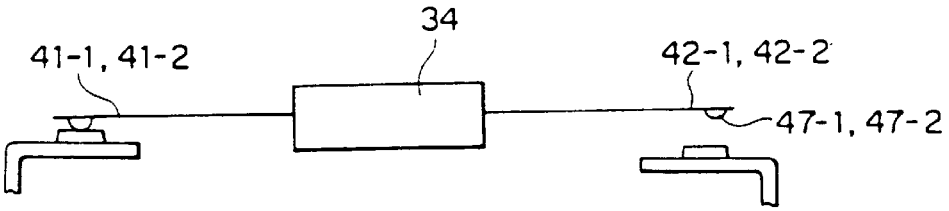
FIG. 3C PRIOR ART
Figure 3D:
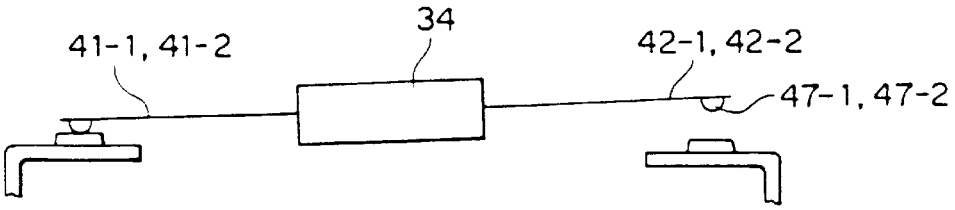
FIG. 3D PRIOR ART
Figures 4A, 4B, 4C, 4D:
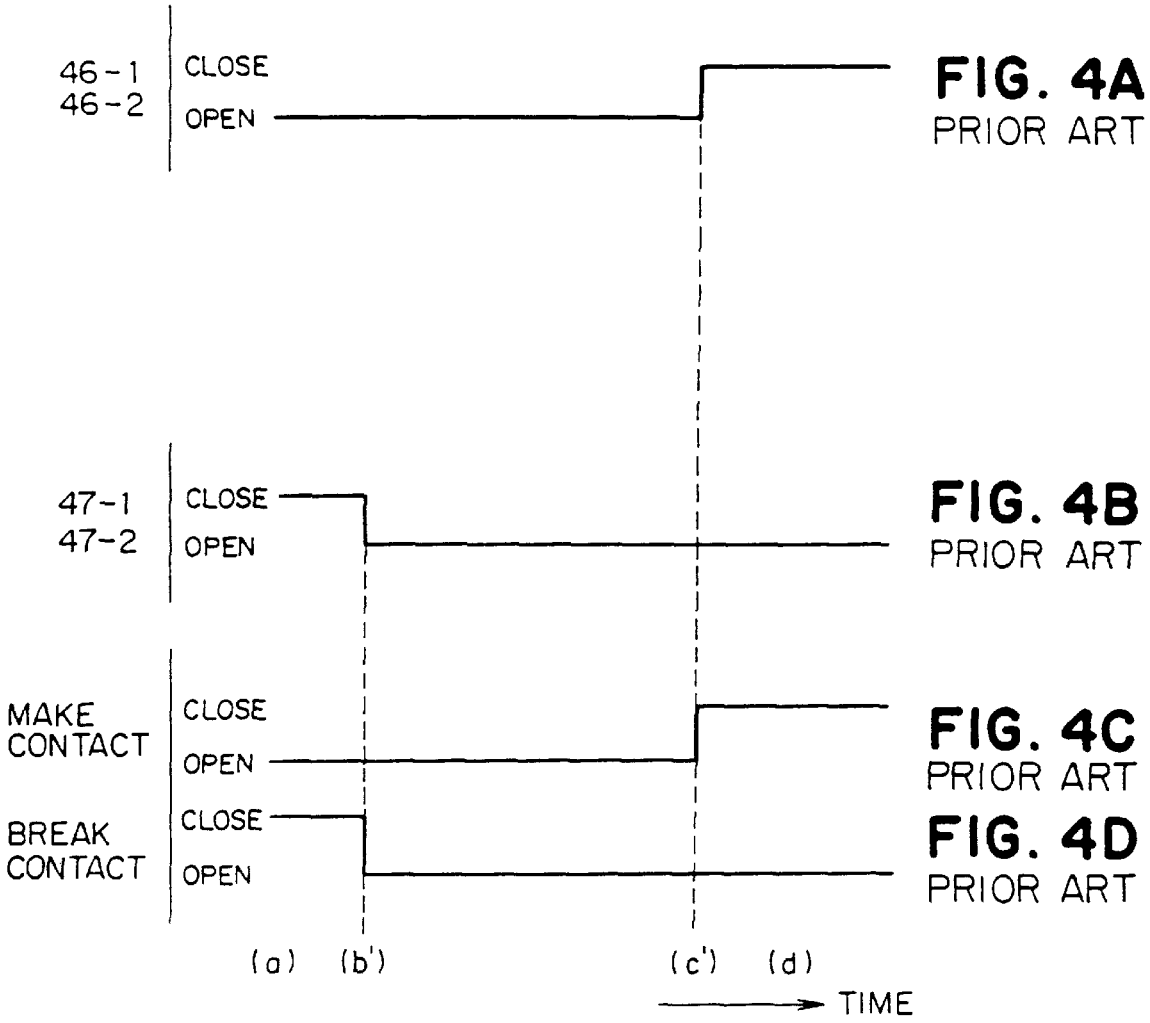
FIG. 4A PRIOR ART
FIG. 4B PRIOR ART
FIG. 4C PRIOR ART
FIG. 4D PRIOR ART
FIGS. 4A through 4D collectively show a time chart for use in describing operation in the case of making the conventional seesaw type electromagnetic relay illustrated in FIG. 1 operable as the transfer contact.

When the electromagnet is excited, the armature 32 (FIG. 1) rotates in a counterclockwise direction. Accordingly, the break contact (the third and the fourth movable contact elements 47-1 and 47 2) opens (as shown in FIG. 3B) at instant (b') in FIGS. 4B and 4D. Accordingly, both the break contact and the make contact are open. That is, a one-point contact is made in the first common contact 381. Thereafter, the make contact (the first and the second movable contact elements 46-1 and 46-2) closes (as shown in FIG. 3C) at instant (c') in FIGS. 4A and 4C and. That is, a two-point contact is made between the make contact and the first common contact 301. The make contact (the first and the second movable contact elements 46-1 and 46-2) is maintained in a closed state while the break contact (the third and the fourth movable contact elements 47-1 and 47-2) is maintained in an open state as shown at instant (d) in FIGS. 4A through 4D and (as shown in FIG. 3D).

Figure 5:
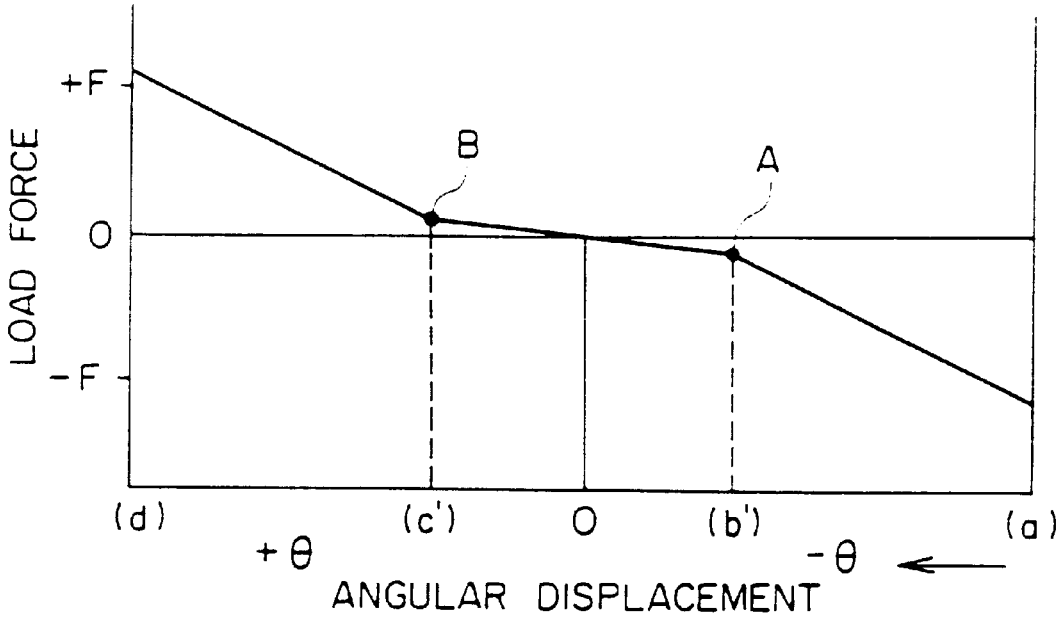
FIG. 5 PRIOR ART
FIG. 5 shows a load characteristic of a first movable spring in the case of making the conventional seesaw type electromagnetic relay illustrated in FIG. 1 operable as the transfer contact.

FIG. 5 shows a load characteristic of the first movable spring 36 in the case of the conventional seesaw type electromagnetic relay illustrated in FIG. 1 operable as a transfer contact. In FIG. 5, abscissa and ordinate represent the angular displacement θ and the load force, respectively. It is assumed that the load force exerted on the break springs 42-1 and 42-2 of the second spring section 42 is negative while the load force exerted on the make springs 41-1 and 41-2 of the first spring section 41 is positive.

When the electromagnet is not excited, the maximum negative load force is exerted on the break springs 42-1 and 42-2 by the urging force of the urging spring as shown at an unoperating position (a) in FIG. 5. With the excitation of the electromagnet, the negative load force exerted on the break springs 42-1 and 42-2 decreases. The break contact 47-1 and 47-2 open at a just break point depicted at A which corresponds to a just break position (b') in FIG. 5. Thereafter, the make contacts 46-1 and 46-2 close at a just make point depicted at B which corresponds to a just make position (c') in FIG. 5. At the just make point B, a positive load force is exerted on the make springs 41-1 and 41-2. With the continued excitation of the electromagnet, the positive load force exerted on the make springs 41 1 and 41-2 increases. Finally, the maximum positive load force is exerted on the make springs 41-1 and 41-2 by magnetic attraction force of the electromagnet as shown at a final operating position (d) in FIG. 5.

Turning to FIGS. 6A through 6D and FIGS. 7A through 7D, description will be made as regards operation in another case of making the conventional seesaw type electromagnetic relay illustrated in FIG. 1 operable as the continuous contact. In the continuous contact, the first through the fourth spring sections 41 to 44 are bent downward as mentioned above. Therefore, the first through the eighth spring pieces in the first through the fourth spring sections 41 to 44 bent are depicted at 41'-1 and 41'-2, 42'-1 and 42'-2, 43'-1 and 43'-2, and 44'-1 and 44'-2, respectively. In addition, each of the first, the second, the fifth, and the sixth spring pieces 41'-1, 41'-2, 43'-1, and 43' 2 is called a bent make spring while each of the third, the fourth, the seventh, and eighth spring pieces 42'-1, 42'-2, 44'-1, and 44'-2 is called a bent break spring.

Figure 6A:
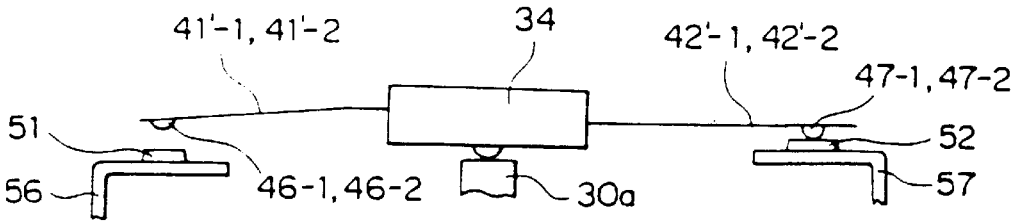
FIG. 6A PRIOR ART
FIGS. 6A through 6D show schematic front views for use in describing operation in another case of making the conventional seesaw type electromagnetic relay illustrated in FIG. 1 operable as a continuous contact.

FIG. 6A shows a state where the electromagnet is not excited. In this state, the make contact (the first and the second movable contact elements 46-1 and 46-2) is open while the break contact (the third and the fourth movable contact elements 47-1 and 47-2) is closed as shown at instant of (a) in FIGS. 7A through 7D (and as shown in FIG. 6A). A two-point contact is made between the break contact and the first common contact 381.

Figure 6B:
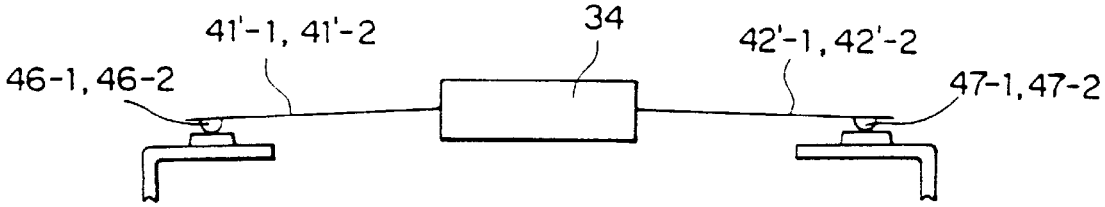
FIG. 6B PRIOR ART
Figure 6C:
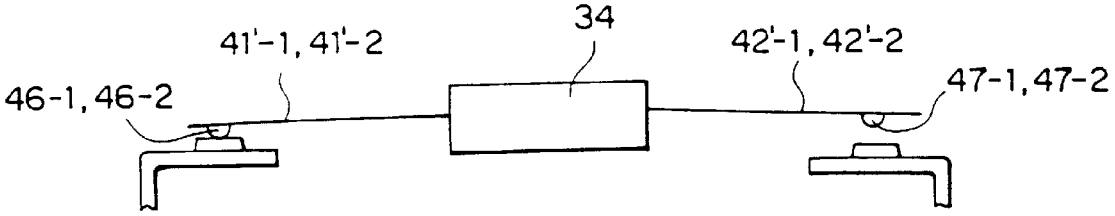
FIG. 6C PRIOR ART
Figure 6D:
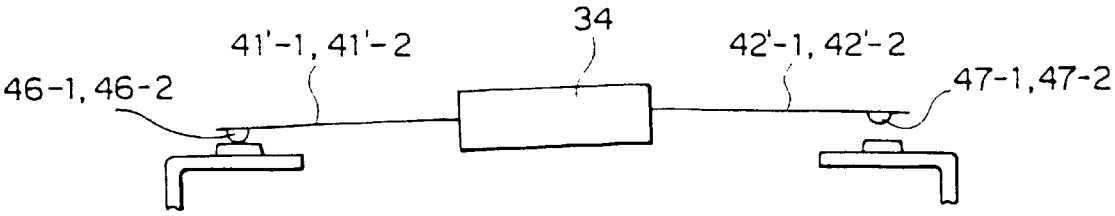
FIG. 6D PRIOR ART
Figures 7A, 7B, 7C, 7D:
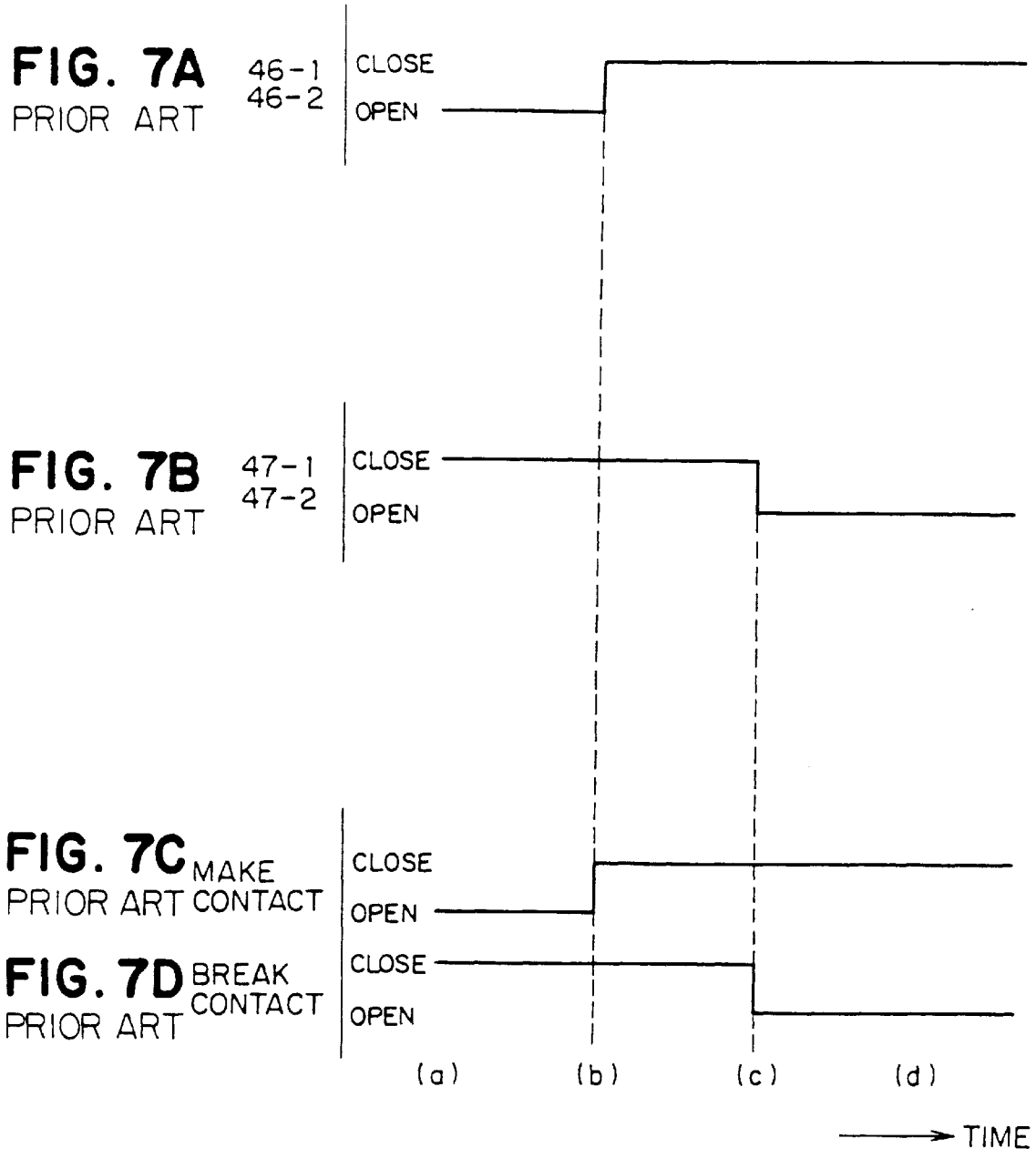
FIG. 7A PRIOR ART
FIG. 7B PRIOR ART
FIG. 7C PRIOR ART
FIG. 7D PRIOR ART
FIGS. 7A through 7D collectively show a time chart for use in describing operation in the other case of making the conventional seesaw type electromagnetic relay illustrated in FIG. 1 operable as the continuous contact.

When the electromagnet is excited, the armature 32 (FIG. 1) rotates in a counterclockwise direction causing the make contact (the first and the second movable contact elements 46 1 and 46-2) to close as shown at instant (b) in FIGS. 7A and 7C (and as shown in FIG. 6B). Accordingly, both of the break contact and the make contact close. That is, a three-point contact is made among the break contact, the first common contact 381, and the make contact. Thereafter, the break contact (the third and the fourth movable contact elements 47-1 and 47-2) opens at instant (c) in FIGS. 7B and 7D (and as shown in FIG. 6C). A two-point contact is made between the make contact and the first common contact 381. The make contact (the first and the second movable contact elements 46-1 and 46-2) is maintained in a closed state while the break contact (the third and the fourth movable contact elements 47-1 and 47-2) is maintained in an open state as shown at instant (d) in FIGS. 7A through 7D (and as shown in FIG. 6D).

Figure 8:
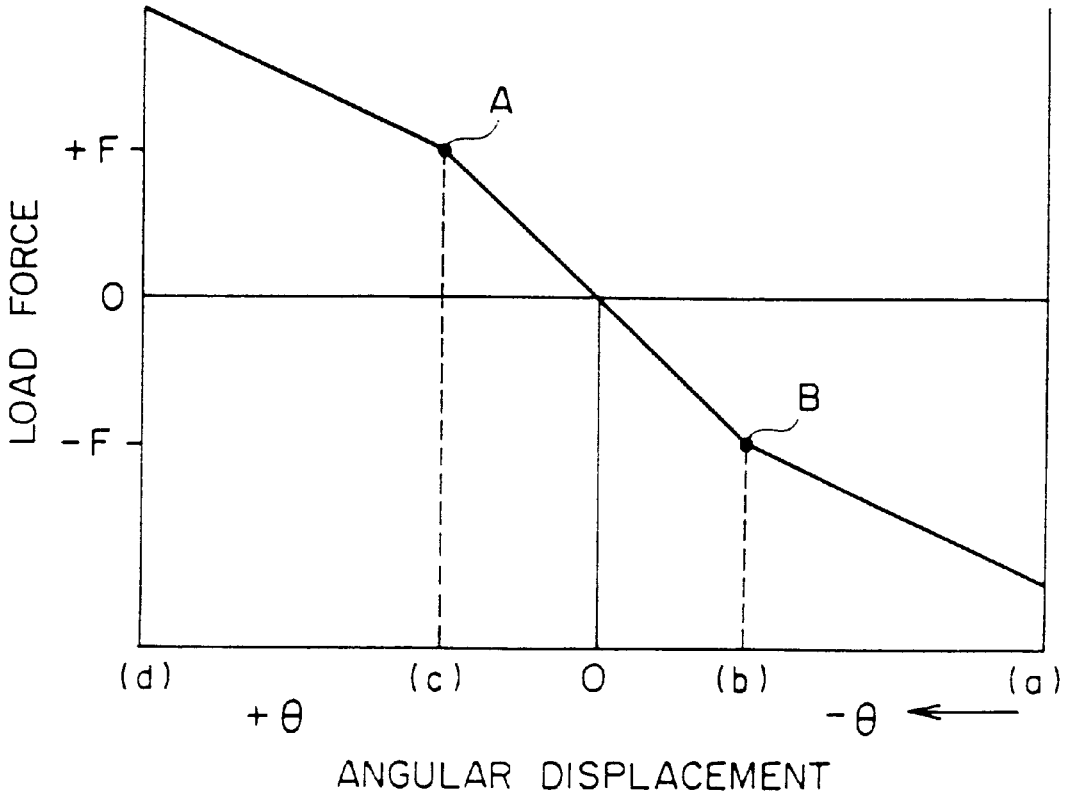
FIG. 8 PRIOR ART
FIG. 8 shows a load characteristic of a first movable spring in the other case of making the conventional seesaw type electromagnetic relay illustrated in FIG. 1 operable as the continuous contact.

FIG. 8 shows a load characteristics of the first movable spring 36 in the case of making the conventional seesaw type electromagnetic relay illustrated in FIG. 1 operable as the continuous contact. In FIG. 8, abscissa and ordinate represent the angular displacement θ and the load force, respectively. It is presumed that the load force exerted on the bent break springs 42'-1 and 42'-2 of the second spring section 42 is negative while the load force exerted on the bent make springs 41'-1 and 41'-2 of the first spring section 41 is positive.

In a nonexcitation state of the electromagnet, the maximum negative load force is exerted on the bent break springs 42'-1 and 42'-2 by the urging force of the urging spring as shown at an unoperating position (a) in FIG. 8. The maximum negative load force in FIG. 8 is stronger than that in FIG. 5. This is because the second spring section 42 is bent downward and the urging spring attempts to rotate the armature 32 in a clockwise direction to resist bending force of the second spring section 42. When the electromagnet is excited, the negative load force exerted on the bent break springs 42'-1 and 42'-2 decreases. The make contact 46-1 and 46-2 closes at the just make point B which corresponds to a just make position (b) in FIG. 8. At the just make point D, the positive load force is exerted on the bent make springs 41'-1 and 41'-2. Thereafter, the break contact 47-1 and 47-2 opens at the just break point A which corresponds to a just break position (c) in FIG. 8. With the excitation of the electromagnet, the positive load force exerted on the bent make springs 41'-1 and 41'-2 increases. Finally, the maximum positive load force is exerted on the bent make springs 41'-1 and 41'-2 by magnetic attraction force of the electromagnet as shown at a final operating position (d) in FIG. 8. The maximum positive load force in FIG. 8 is stronger than that in FIG. 5. This is because the first spring section 41 is bent downward and the electromagnet must rotate the armature 32 in a counterclockwise direction to resist bending force of the first spring section 41.

As apparent from comparison between FIGS. 5 and 8, the just break point A and the just make point B in the continuous contact are positioned with those in the transfer contact reversed. As a result, a large load energy is required in the continuous contact to drive the continuous contact in comparison with the transfer contact. This is because as the bent displacement of the bent make springs 41'-1 and 41'-2 and the bent break springs 42'-1 and 42' 2 increases, the pressure exerted on the bent make springs 41'-1 and 41'-2 and the bent break springs 42'-1 and 42'-2 increases.

As described above, the conventional seesaw type electromagnetic relay serving as the continuous relay has the steep load characteristic as shown in FIG. 8. As a result, there is little margin for a matching between the magnetic attraction force of the electromagnet and the urging force of the urging spring. The conventional seesaw type electromagnetic relay serving as the continuous relay is disadvantageous in that it consumes large power when it is driven.

Various other electromagnetic relays have been proposed in, for example, Japanese Unexamined Utility Model Prepublication or Jikkai Nos. Sho 60-168,243 (168,243/1985), Hei 2-18,246 (18,246/1990), and Hei 4-78,720 (78,720/1992). Those Prepublications disclose the electromagnetic relays where a distance between an movable contact element of a twin movable contact and a fixed contact is different from another distance between another movable contact element of the twin movable contact and the fixed contact.

Figure 9A:
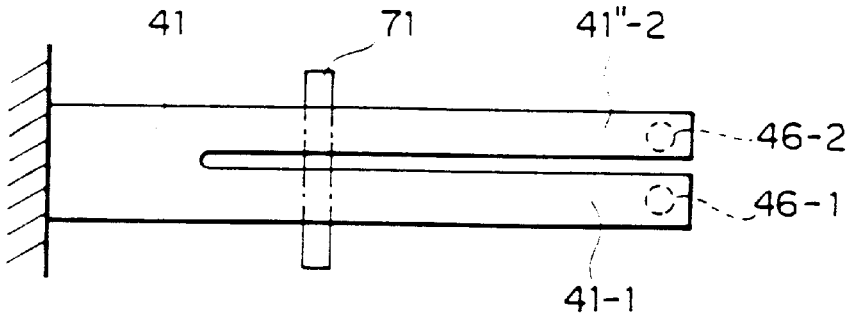
FIG. 9A PRIOR ART
FIGS. 9A through 9C collectively show a conventional electromagnetic relay acting as a make contact.
Figure 9B:
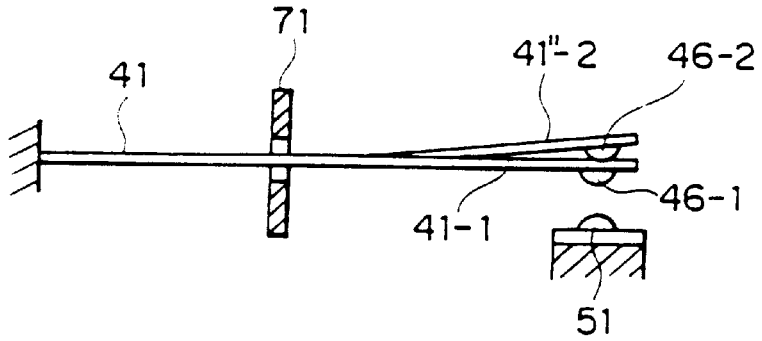
FIG. 9B PRIOR ART
Figure 9C:
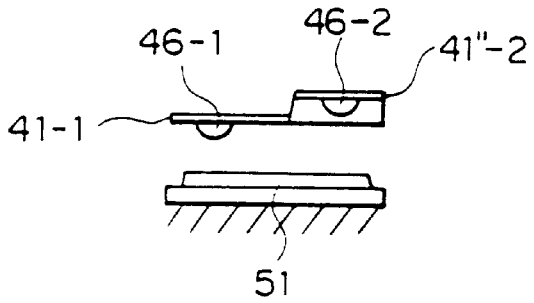
FIG. 9C PRIOR ART

Turning to FIGS. 9A through 9C, the description will proceed to the electromagnetic relay disclosed in Jikkai No. Sho 60-168,243. FIGS. 9A through 9C show a plan view, a front view, a side view, respectively.

The illustrated electromagnetic relay is of cantilever boom type and comprises the spring section 41. The spring section 41 has U-shaped or fork-shaped and forks into two branches to form first and second spring pieces 41-1 and 41"-2. In the example being illustrated, the first and the second spring pieces 41-1 and 41"-2 serve as first and second make springs, respectively. The first make spring 41-1 has substantially flat shape while the second make spring 41"-2 is bent upward. Accordingly, the first make spring 41-1 is called a flat make spring while the second make spring 41"-2 is called a bent make spring. The first and the second make springs 41-1 and 41"-2 have first and second end parts, respectively, at which the first and the second movable contact elements 46-1 and 46-2 are mounted on bottom surfaces of thereof, respectively. A combination of the first and the second movable contact elements 46-1 and 46 2 is called a twin movable contact. The twin movable contact faces the fixed contact 51.

As shown in FIGS. 9B and 9C, a first distance between the first movable contact element 46-1 and the fixed contact 51 is different from a second distance between the second movable contact element 46-2 and the fixed contact 51. That is, the first distance is shorter than the second distance. In other words, the twin movable contact has a difference in level. The spring section 41 is swingably driven up and down by a card 71.

Figure 10A:
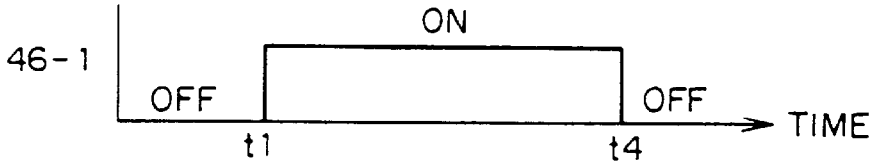
FIG. 10A PRIOR ART
FIGS. 10A and 10B collectively show a time chart for use in describing operation of the conventional electromagnetic relay illustrated in FIGS. 9A through 9C.
Figure 10B:
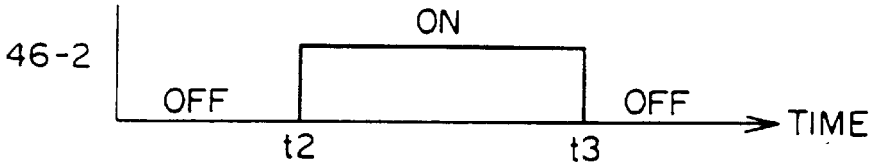
FIG. 10B PRIOR ART

Turning to FIGS. 10A and 10B, description will be made as regards operation of the electromagnetic relay illustrated in FIGS. 9A through 9C. With a downward motion of the card 71, the spring section 41 moves downward. As a result, the first movable contact element 46-1 comes first in contact with the fixed contact 51 to be turned on as shown at a time instant $t_1$ in FIG. 10A and the second movable contact element 46-2 comes in late in contact with the fixed contact 51 to be turned on as shown at a time instant $t_2$ in FIG. 10B. Thereafter, with an upward motion of the card 71, the spring section 41 moves upward. As a result, the second movable contact element 46-2 separates first from the fixed contact 51 to be turned off as shown at a time instant $t_3$ in FIG. 10B and the first movable contact element 46-1 separates in late from the fixed contact 51 to be turned off as shown at a time instant $t_4$ in FIG. 10A.

However, all of the above-mentioned Prepublications only disclose the electromagnetic relays each of which acts as the make contact. In other words, none of the Prepublications either disclose or teach an electromagnetic relay acting as a continuous contact.

Figure 11:
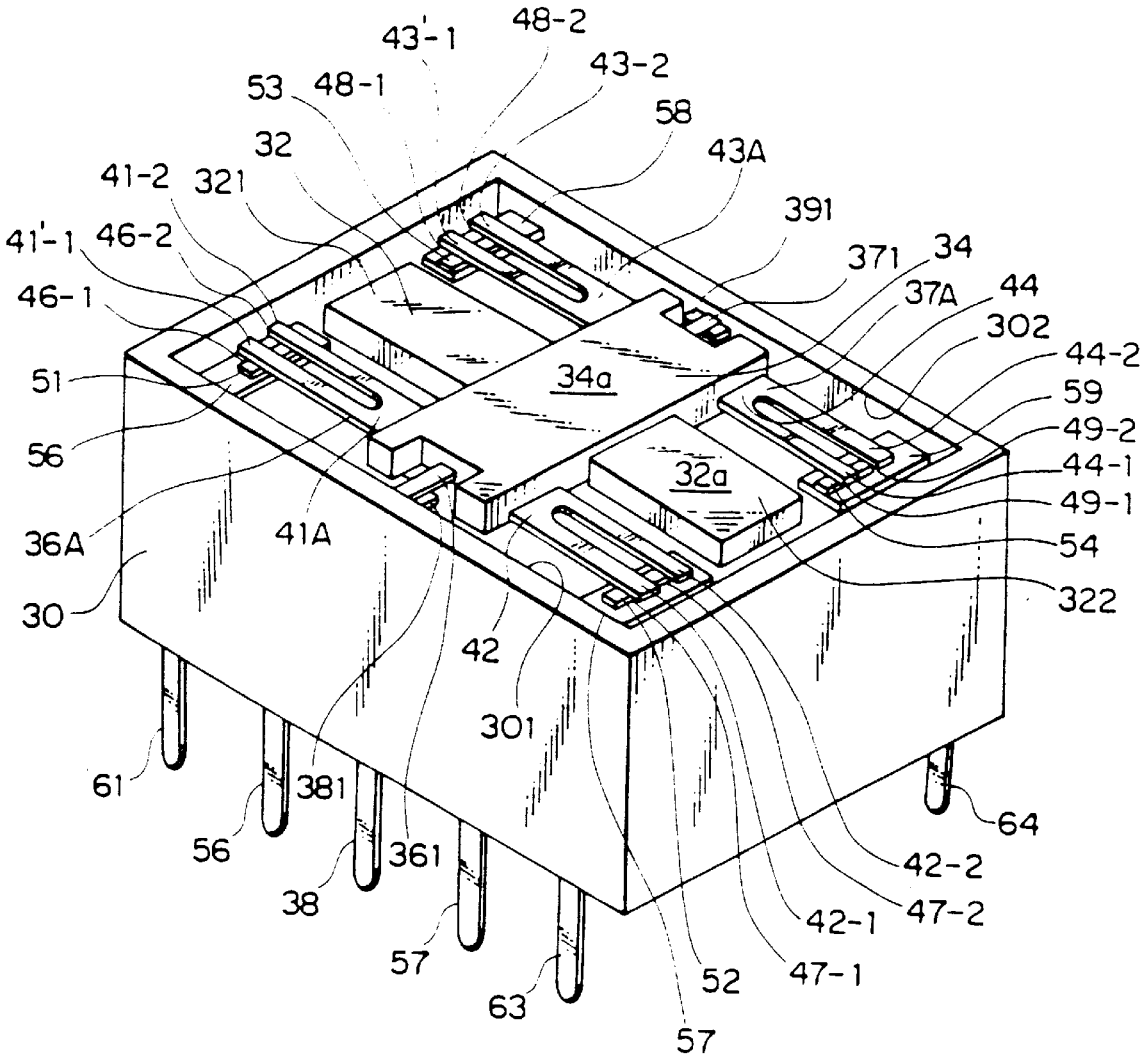
FIG. 11 is a perspective view of a seesaw type electromagnetic relay according to a first embodiment of this invention.

Referring to FIG. 11, a seesaw type electromagnetic relay according to a first embodiment of the present invention is shown. The illustrated seesaw type electromagnetic relay is similar in structure to that illustrated in FIG. 1 except that the first and the second movable springs are modified to be different from those of FIG. 1. The first and the second movable springs are therefore depicted at 36A and 37A, respectively.

The first movable spring 36A is similar in structure to the first movable spring 36 illustrated in FIG. 1 except that the first spring section is modified to be different from that described in conjunction with FIG. 1. The first spring section is therefore depicted at 41A. Likewise, the second movable spring 37A is similar in structure to the second movable spring 37 illustrated in FIG. 1 except that the third spring section is modified to be different from that described in conjunction with FIG. 1. The third spring section is therefore depicted at 43A.

Figure 12:
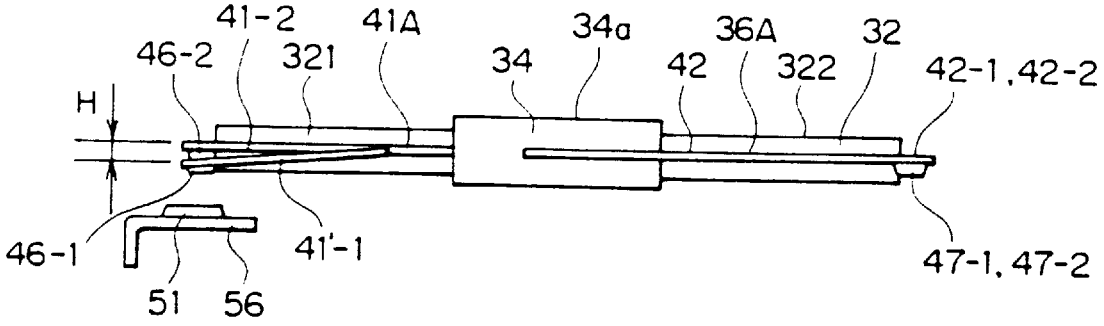
FIG. 12 is a schematic front view of the seesaw type electromagnetic relay illustrated in FIG. 11.

Turning to FIG. 12, the first spring section 41A forks into two branches to form first and second spring pieces 41' 1 and 41-2. The first spring piece 41'-1 is bent downward as illustrated in FIG. 12 while the second spring piece 41-2 has a substantially flat shape. As described above, each of the first and the second spring pieces 41' 1 and 41-2 acts as the make spring. The first spring piece 41'-1 is called a bent make spring while the second spring piece 41-2 is called a flat make spring. The bent make spring 41'-1 has a first free end part at which the first movable contact element 46-1 is mounted on a bottom surface thereof. The flat make spring 41-2 has a second free end part at which the second movable contact element 46-2 is mounted on a bottom surface thereof. As a result, in an open state, a first distance between the first movable contact element 46-1 and the first fixed contact 51 is difference from a second distance between the second movable contact element 46-2 and the first fixed contact 51. A combination of the first and the second movable contact elements 46-1 and 46-2 is called the first twin movable contact. The first twin movable contact has a difference H in level as shown in FIG. 12.

Turning back to FIG. 11, the third spring section 43A forks into two branches to form fifth and sixth spring pieces 43'-1 and 43-2. The fifth spring piece 43'-1 is bent downward like in the first spring piece 41' 1 illustrated in FIG. 12 while the sixth spring piece 43-2 has a substantially flat shape. Likewise, the contact pieces 43'-1 and 43-2 act as the make springs. The fifth spring piece 43'-1 is called a bent make spring while the sixth spring piece 43-2 is called a flat make spring. The bent make spring 43'-1 has a fifth free end part at which the fifth movable contact element 48-1 is mounted on a bottom surface thereof. The flat make spring 43-2 has a sixth free end part at which the sixth movable contact element 48-2 is mounted on a bottom surface thereof. As a result, in an open state, a fifth distance between the fifth movable contact element 48-1 and the third fixed contact 53 is different from a sixth distance between the sixth movable contact element 48-2 and the third fixed contact 53. A combination of the fifth and the sixth movable contact elements 48-1 and 48 2 is called the third twin movable contact. The third twin movable contact has the difference H in level like in the first twin movable contact illustrated in FIG. 12.

Turning to FIGS. 13A through 13D and FIGS. 14A through 14E, description will be made as regards operation of the seesaw type electromagnetic relay illustrated in FIG. 11.

Figure 13A:
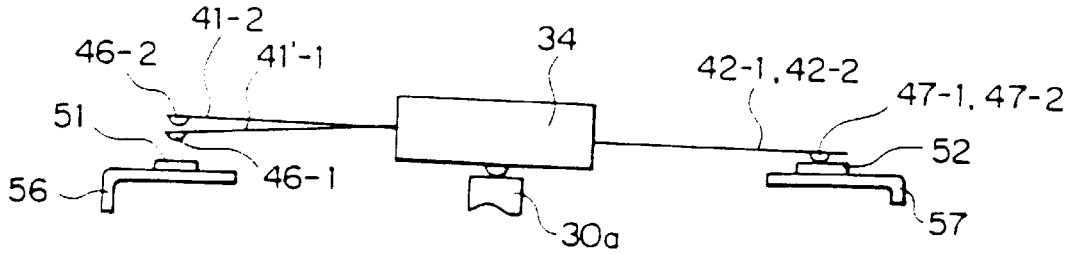
FIGS. 13A through 13D show schematic front views for use in describing operation of the seesaw type electromagnetic relay illustrated in FIG. 11.

FIG. 13A shows a state where the electromagnet is not excited. In this state, the make contact (the first and the second movable contact elements 46-1 and 46-2) is opened while the break contact (the third and the fourth movable contact elements 47-1 and 47-2) is closed as shown at instant (a) in FIGS. 14A through 14E. That is, a two-point contact is made between the break contact and the first common contact 381.

Figure 13B:
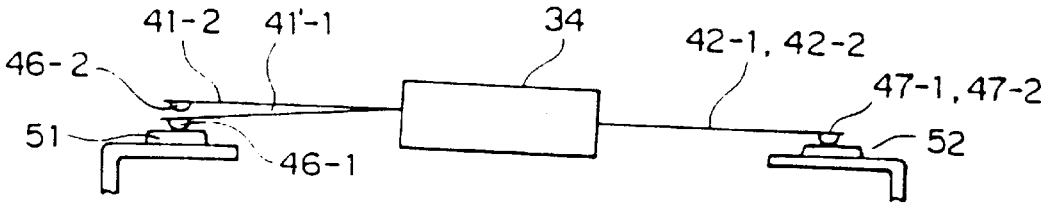
Figure 13C:
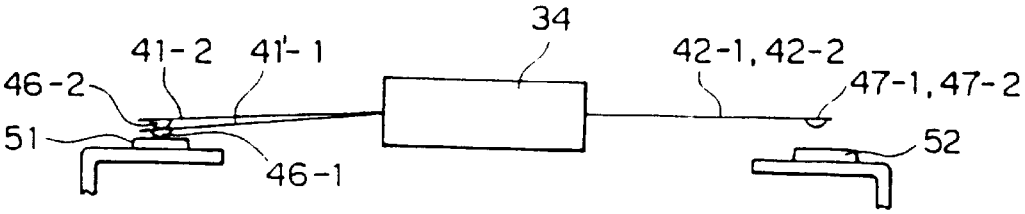
Figure 13D:
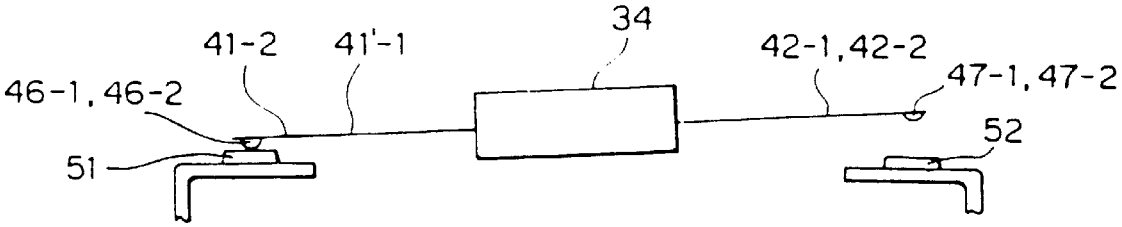
Figures 14A, 14B, 14C, 14D, 14E:
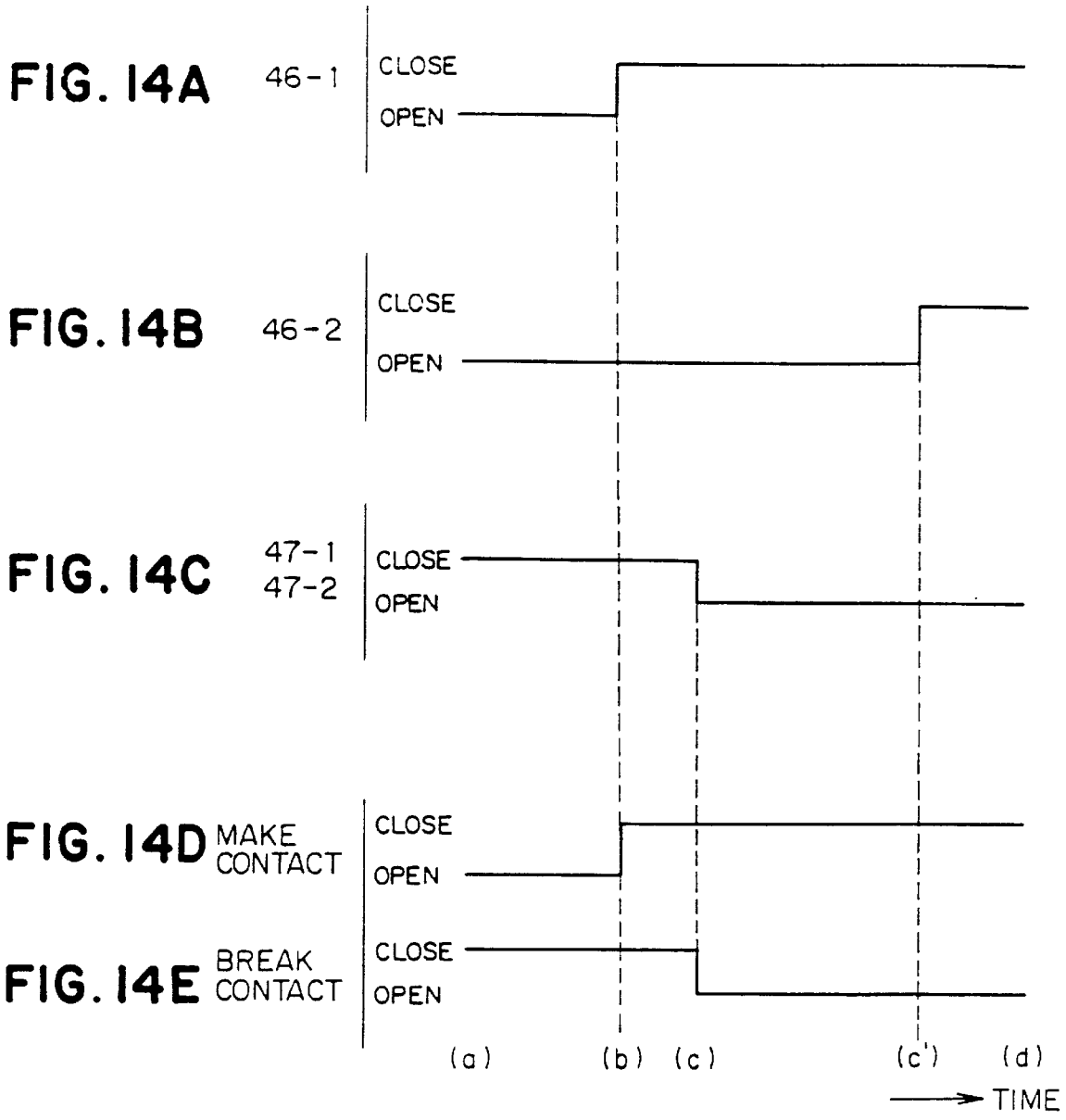
FIGS. 14A through 14E collectively show a time chart for use in describing operation of the seesaw type electromagnetic relay illustrated in FIG. 11.

When the electromagnet is excited, the armature 32 (FIG. 11) rotates in a counterclockwise direction. Accordingly, the first movable contact elements 46-1 closes as shown at instant (b) in FIG. 14A (and as illustrated in FIG. 13B). At this instant, both the break contact and the make contact are closed as shown in FIG. 13B. In this condition, a three-point contact is made among the break contact, the first common contact 381, and the make contact. Thereafter, the break contact (the third and the fourth movable contact elements 47-1 and 47-2) opens at instant (b') in FIGS. 14C (and 14E and as illustrated in FIG. 13C). The second movable contact element 46-2 closes at instant (c') in FIG. 14B (and as illustrated in FIG. 13C). Finally, the make contact (the first and the second movable contact elements 47-1 and 47-2) is maintained in a closed state while the break contact (the third and the fourth movable contact elements 47-1 and 47 2) is maintained in an open state, as shown at instant (d) in FIGS. 14A through 14E (and as illustrated in FIG. 13D).

As described above, it is possible to make the seesaw type electromagnetic relay according to the first embodiment operable as a continuous contact. In addition, inasmuch as only the first spring piece 41'-1 in the first movable spring 41A is bent downward, it is possible to decrease the load energy upon driving of it and the seesaw type electromagnetic relay has a light load characteristic. As a result, there is a large margin to matching the magnetic attraction force of the electromagnet and the urging force of the urging spring. The seesaw type electromagnetic relay according to the first embodiment consumes low power when it is driven.

Although one of the make springs in the movable spring is bent downward in the above-mentioned first embodiment, one of the break springs in the movable spring may also be bent downward.

Figure 15:
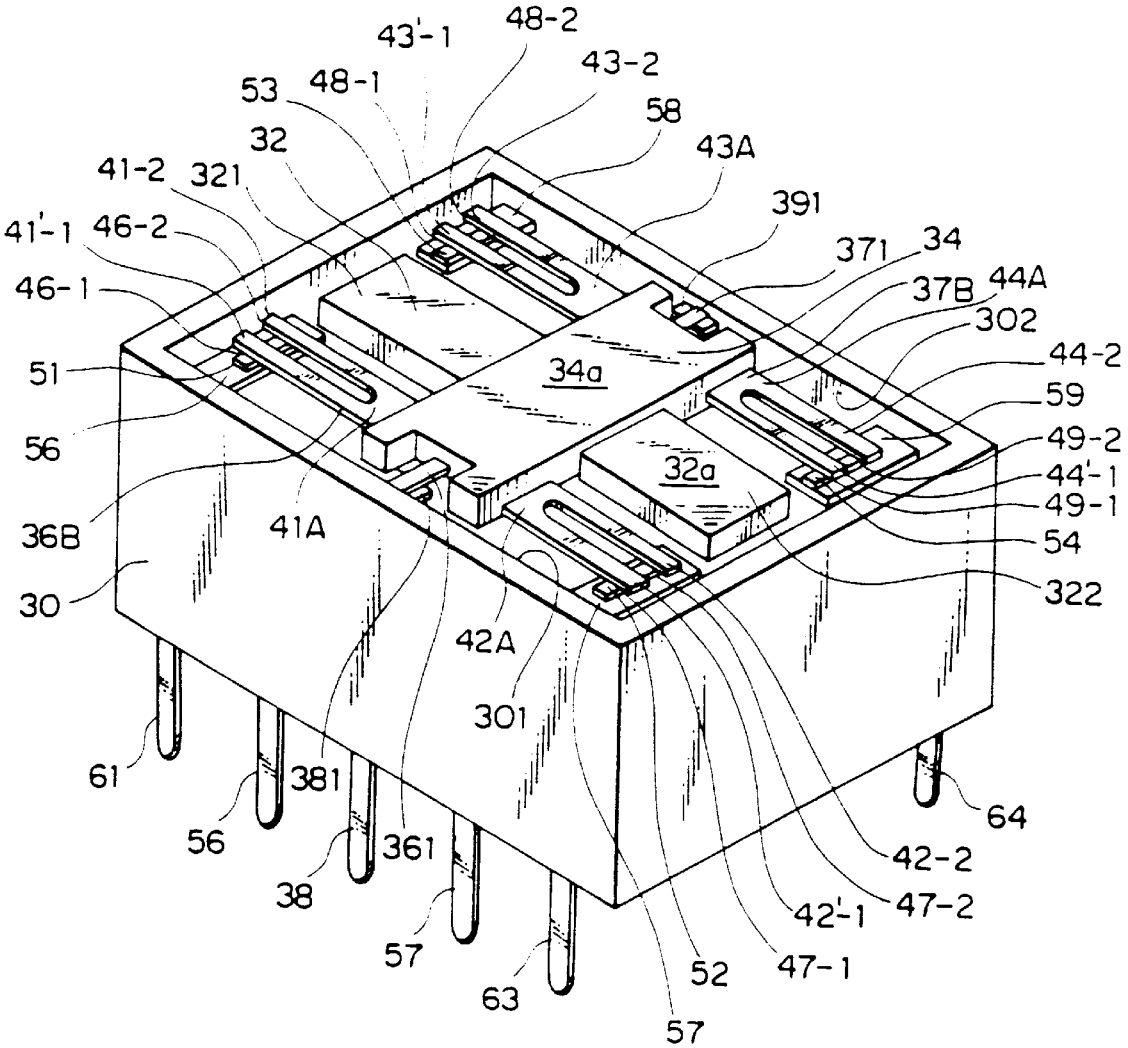
FIG. 15 is a perspective view of a seesaw type electromagnetic relay according to a second embodiment of this invention.

Referring to FIG. 15, the description will proceed to a seesaw type electromagnetic relay according to a second embodiment of this invention. The illustrated seesaw type electromagnetic relay is similar in structure to that illustrated in FIG. 11 except that the first and the second movable springs are modified to be different from those described in conjunction with FIG. 11 as will later become clear. The first and the second movable springs are therefore depicted at 36B and 37B, respectively.

The first movable spring 36B is similar in structure to the first movable spring 36A illustrated in FIG. 11 except that the second spring section is modified to be different from that described in conjunction with FIG. 1. The second spring section is therefore depicted at 42A. Likewise, the second movable spring 37B is similar in structure to the second movable spring 37A illustrated in FIG. 11 except that the fourth spring section is modified to be different from that described in conjunction with FIG. 1. The fourth spring section is therefore depicted at 44A.

The second spring section 42A is similar in structure to the first spring section 41A. More specifically, the second spring section 42A forks into two branches to form third and fourth spring pieces 42'-1 and 42-2. The third spring piece 42'-1 is bent downward while the fourth contact piece 42-2 has a substantially flat shape. As described above, each of the third and the fourth spring pieces 42'-1 and 42-2 acts as the break spring. The third spring piece 42'-1 is called a bent break spring while the fourth spring piece 42-2 is called a flat break spring. The bent break spring 42'-1 has a third free end part at which the third movable contact element 47 1 is mounted on a bottom surface thereof. The flat break spring 42-2 has a fourth free end at which the fourth movable contact element 47-2 is mounted on a bottom surface thereof. As a result, in an open state, a third distance between the third movable contact element 47-1 and the second fixed contact 52 is different from a fourth distance between the fourth movable contact element 47-2 and the second fixed contact 52. A combination of the third and the fourth movable contact elements 47-1 and 47-2 is called the second twin movable contact. The second movable contact has the difference H in level like in the first twin movable contact illustrated in FIG. 12.

The fourth spring section 44A is similar in structure to the third spring section 43A. More specifically, the fourth spring section 44A forks into two branches to form seventh and eighth spring pieces 44'-1 and 42-2. The seventh spring piece 44'-1 is bent downward like in the first spring piece 41'-1 illustrated in FIG. 12 while the eighth spring piece 44-2 has a substantially flat shape. Likewise, each of the seventh and the eighth spring pieces 44'-1 and 44-2 act as the break spring. The seventh spring piece 44'-1 is called a bent break spring while the eighth spring piece 44-2 is called a flat break spring. The bent break spring 44'-1 has a seventh free end part at which the seventh movable contact element 49-1 is mounted on a bottom surface thereof. The flat break spring 44 2 has an eighth free end at which the eighth movable contact element 49-2 is mounted on a bottom surface thereof. As a result, in an open state, a seventh distance between the seventh movable contact element 49-1 and the fourth fixed contact 54 is different from an eight distance between the eighth movable contact element 49-2 and the fourth fixed contact 54. A combination of the seventh and the eighth movable contact elements 49-1 and 49-2 is called the fourth twin movable contact. The fourth twin movable contact has the difference H in level like in the first twin movable contact illustrated in FIG. 12.

Turning to FIGS. 16A through 16D and FIGS. 17A through 17F, description will be made as regards operation of the seesaw type electromagnetic relay illustrated in FIG. 15.

Figure 16A:
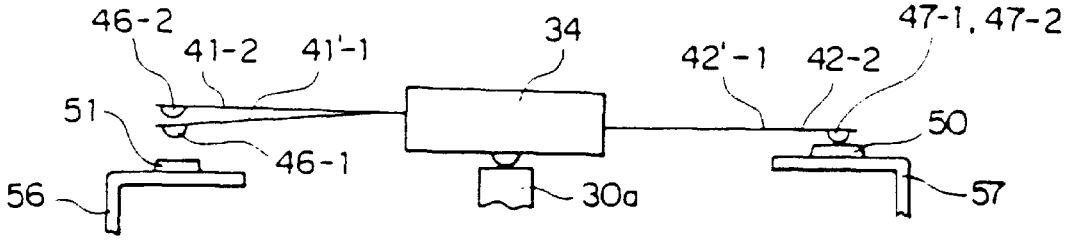
FIGS. 16A through 16D show schematic front views for use in describing operation of the seesaw type electromagnetic relay illustrated in FIG. 15.

FIG. 16A shows a state where the electromagnet is not excited. In this state, the make contact (the first and the second movable contact elements 46-1 and 46-2) opens while the break contact (the third and the fourth movable contact elements 47 1 and 47-2) closes as shown at a timing of (a) in FIGS. 17A and 17F. That is, a two-point contact is made between the break contact and the first common contact 381.

Figure 16B:
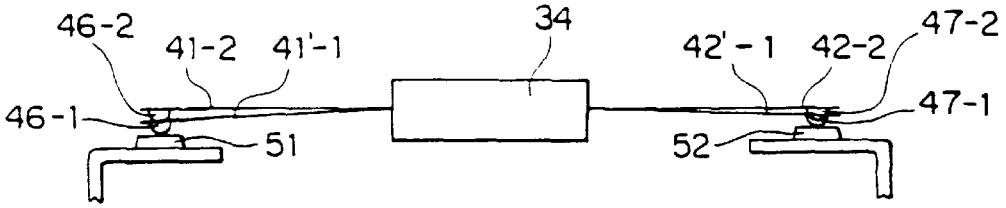
Figure 16C:
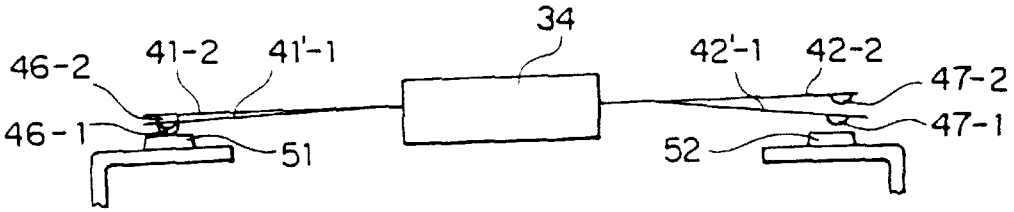
Figure 16D:
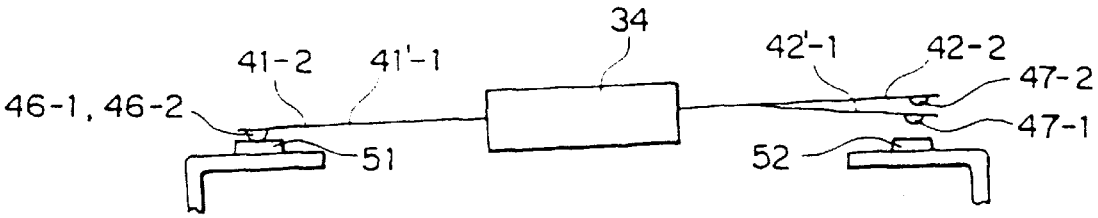
Figures 17A, 17B, 17C, 17D:
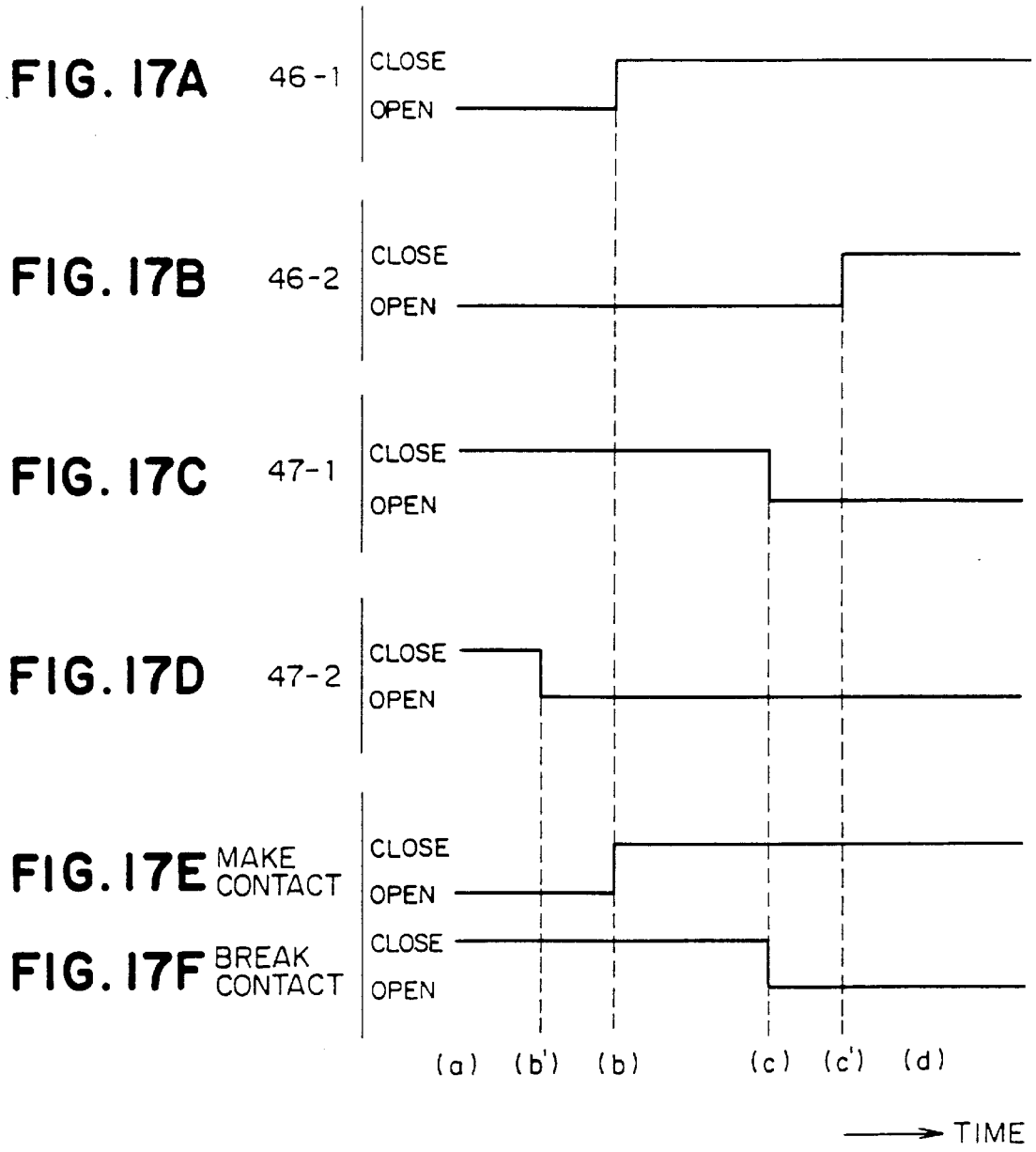

It will be assumed that the electromagnet is excited in this state. Under the circumstances, the armature 32 (FIG. 15) rotates in a counterclockwise direction. Accordingly, the fourth movable contact element 47-2 opens as shown at a timing of (b') in FIG. 17D. Subsequently, the first movable contact element 46-1 closes as shown at a timing of (b) in FIG. 17A and as shown in FIG. 16B. In this event, both of the break contact and the make contact close. That is, a three-point contact is made among the break contact, the first common contact 381, and the make contact. Thereafter, the third movable contact element 47-1 opens as shown at a timing of (c) in FIGS. 17C and as shown in FIG. 16C. Accordingly, the break contact opens as shown at the timing (c) in FIG. 17F. That is, a two-point contact is made between the make contact and the first common contact 381. And then, the second movable contact element 46-2 opens as shown at a timing of (c') in FIG. 17B. Finally, the make contact (the first and the second movable contact elements 46-1 and 46-2) is maintained in a closed state while the break contact (the third and the fourth movable contact elements 47-1 and 47-2) is maintained in an open state, as shown at a timing of (d) in FIGS. 17A through 17F and as shown in FIG. 16D.

Figure 18:
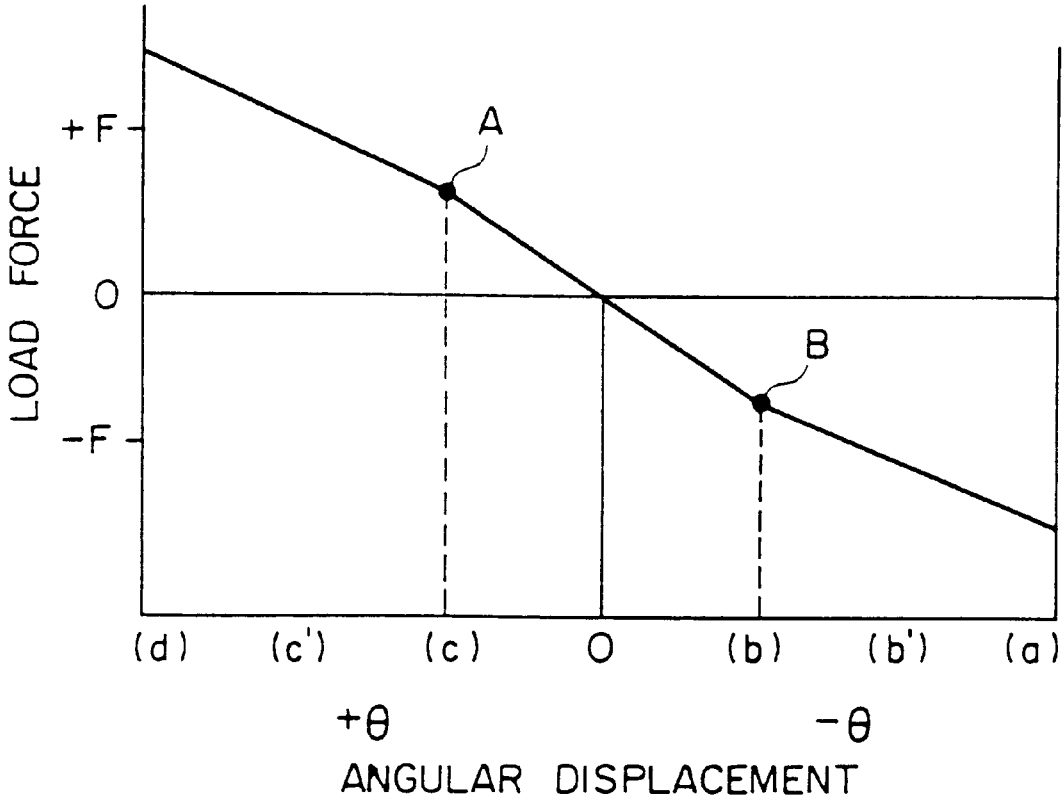
FIG. 18 shows a load characteristic of a first movable spring in the seesaw type electromagnetic relay illustrated in FIG. 15.

FIG. 18 shows a load characteristic of the first movable spring 36B of the seesaw type electromagnetic relay illustrated in FIG. 15. In FIG. 18, abscissa and ordinate represent the angular displacement θ and the load force, respectively. It is presumed that the load force exerted on the second spring section 42A (the bent break spring 42'-1 and the flat break spring 42-2) is negative while the load force exerted on the first spring section 41A (the bent make spring 41'-1 and the flat make spring) 41-2 is positive.

When the electromagnet is not excited, the maximum negative load force is exerted on the bent break spring 42'-1 and the flat break spring 42-2 by urging force of the urging spring as shown at the non operating position (a) in FIG. 18. The maximum negative load force in FIG. 18 is weaker than that in FIG. 8. This is because only the bent break spring 42'-1 (and not the break spring 42-2) in the second spring section 42A is bent downward and the urging spring may rotate the armature 32 in a clockwise direction to resist bending force of the bent break spring 42'-1 in the second spring section 42A. With the excitation of the electromagnet, the negative load force exerted on the bent break spring 42'-1 and the flat break spring 42-2 decreases. The fourth movable contact element 47-2 of the break contact opens at a position (b') in FIG. 18. Subsequently, the first movable contact element 46-1 of the make contact closes at the just make point B which corresponds to a just make position (b) in FIG. 18. At the just make point B, the positive load force exerts on the bent make spring 41'-1 alone. Thereafter, the third movable contact element 47-1 of the break contact opens at the just break point A which corresponds to a just break position (c) in FIG. 18. With the excitation of the electromagnet, the positive load force exerted on the first spring section 41B increases. And then, the second movable contact element 46-2 of the make contact closes at a position (c') in FIG. 18. Finally, the maximum positive load force exerts on the bent make spring 41'-1 and the flat make spring 41-2 by magnetic attraction force of the electromagnet as shown at a final operating position (d) in FIG. 18. The maximum positive load force in FIG. 18 is weaker than that in FIG. 8. This is because only the bent make spring 41'-1 in the first spring section 41A is bent downward and the electromagnet may rotate the armature 32 in a counterclockwise direction to resist bending force of the bent make spring 41'-1 in the first spring section 41A.

With this structure, it is possible to make the seesaw type electromagnetic relay according to the second embodiment operable as the continuous contact. In addition, inasmuch as only the first spring piece 41'-1 in the first movable spring 41A and the third spring piece 42'-1 in the second movable spring 42A are bent downward, it is possible to decrease the load energy upon driving of it in comparison with the conventional electromagnetic relay serving as the continuous contact. In addition, the seesaw type electromagnetic relay has the gentle load characteristics as shown in FIG. 18. As a result, there is much margin for a matching between the magnetic attraction force of the electromagnet and the urging force of the urging spring. The seesaw type electromagnetic relay according to the second embodiment consumes small power upon driving of it in comparison with the conventional electromagnetic relay serving as the continuous contact.

Figure 19:
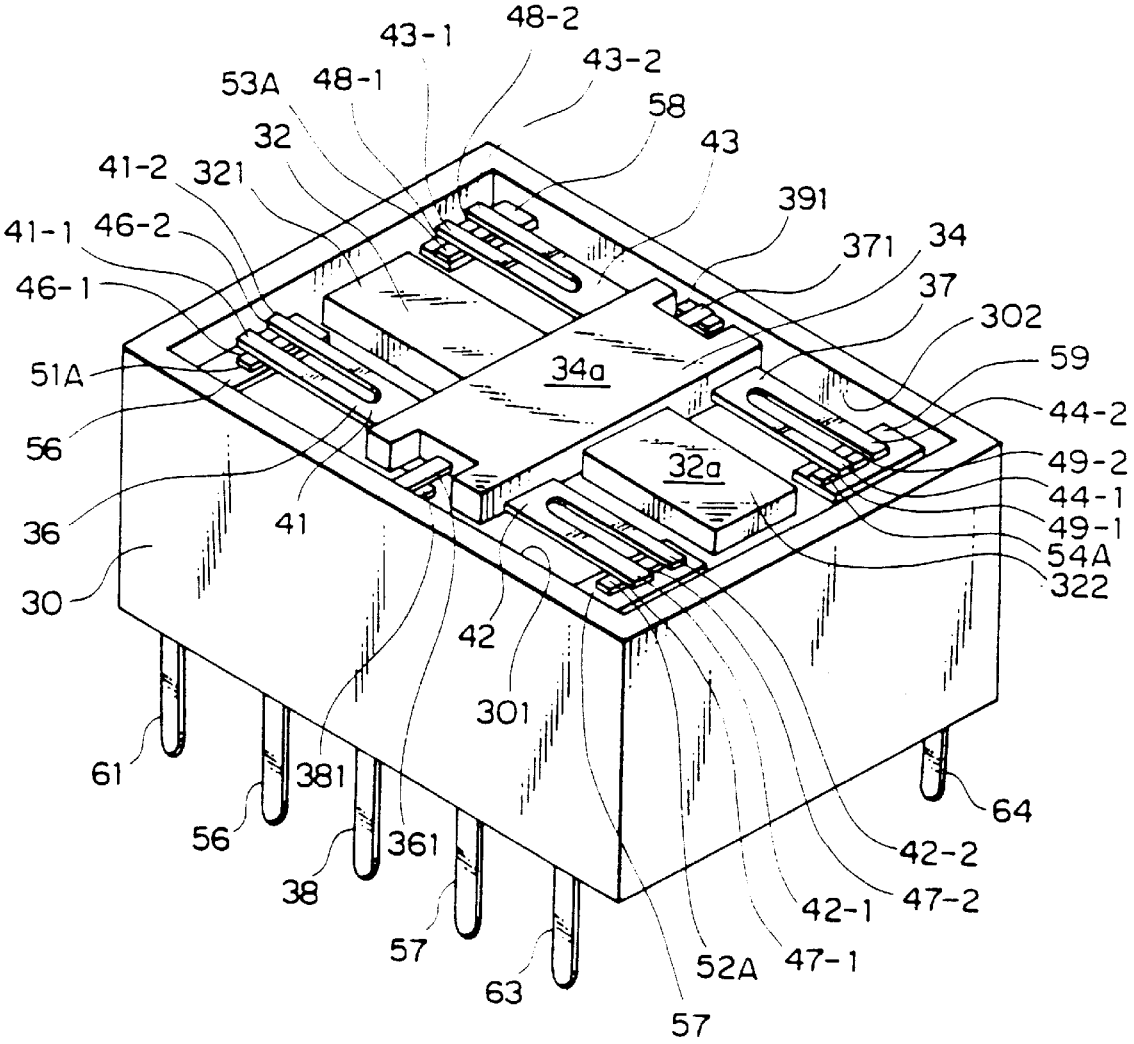
FIG. 19 is a perspective view of a seesaw type electromagnetic relay according to a third embodiment of this invention.

Referring to FIG. 19, the description will proceed to a seesaw type electromagnetic relay according to a third embodiment of this invention. The illustrated seesaw type electromagnetic relay is similar in structure to that illustrated in FIG. 1 except that the first through the fourth fixed contacts are modified to be different from those described in conjunction with FIG. 1 as will later become clear. The first through the fourth fixed contacts are therefore depicted at 51A, 52A, 53A, and 54A, respectively.

Figure 20:
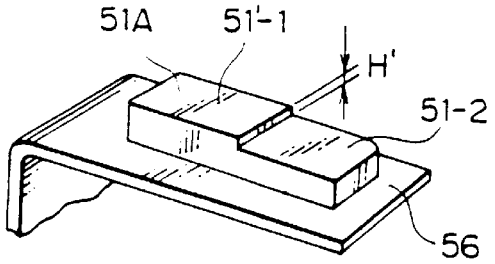
FIG. 20 is a perspective view of a fixed contact for use in the seesaw type electromagnetic relay illustrated in FIG. 19.

Turning to FIG. 20, the first fixed contact 51A comprises first and second fixed contact elements 51'-1 and 51-2. The first fixed contact element 51'-1 has a first height while the second fixed contact element 51-2 has a second height. As shown in FIG. 20, the first height is higher than the second height. A combination of the first and the second fixed contact elements 51'-1 and 51-2 is called a first twin fixed contact. That is, the first twin fixed contact has a difference H' in level as shown in FIG. 20. Likewise, the second through the fourth fixed contacts 52A to 54A consist of second through fourth twin fixed contacts, respectively, each of which has the difference H' in level like in the first twin fixed contact illustrated in FIG. 20.

Figure 21A:
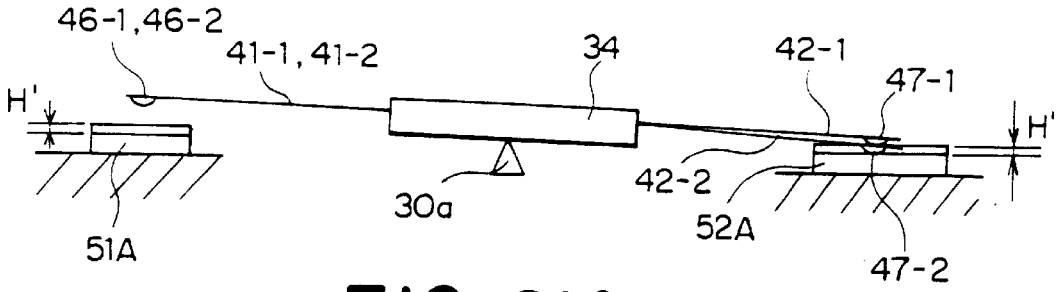
FIGS. 21A through 21C show schematic front views for use in describing operation of the seesaw type electromagnetic relay illustrated in FIG. 19.
Figure 21B:
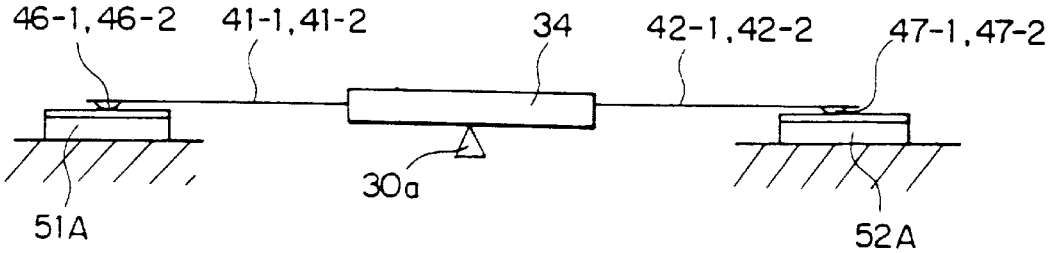
Figure 21C:
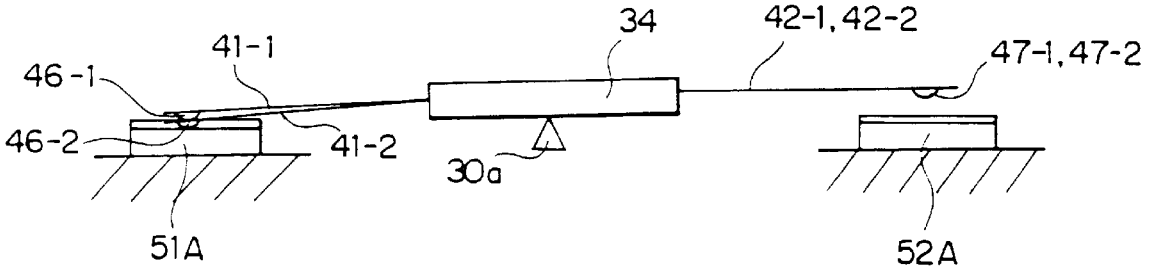

Turning to FIGS. 21A through 21C, description will be made as regards operation of the seesaw type electromagnetic relay illustrated in FIG. 19.

FIG. 21A shows a state where the electromagnet is not excited. In this state, the make contact (the first and the second movable contact elements 46-1 and 46-2) opens while the break contact (the third and the fourth movable contact elements 47-1 and 47-2) closes as shown in FIG. 21A. That is, a two-point contact is made between the break contact and the first common contact 381.

It will be assumed that the electromagnet is excited in this state. Under the circumstances, the armature 32 (FIG. 19) rotates in a counterclockwise direction. Accordingly, the fourth movable contact element 47-2 opens and the first movable contact element 46-1 closes as shown in FIG. 21B. In this event, both of the break contact and the make contact close. That is, a three-point contact is made among the break contact, the first common contact 381, and the make contact. Thereafter, the third movable contact element 47-1 opens and the second movable contact element 46-2 closes as shown in FIG. 21C. That is, a two-point contact is made between the make contact and the first common contact 381. Accordingly, the make contact (the first and the second movable contact elements 46-1 and 46-2) is maintained in a closed state while the break contact (the third and the fourth movable contact elements 47-1 and 47-2) is maintained in an open state.

With this structure, it is possible to make the seesaw type electromagnetic relay according to the third embodiment operable as the continuous contact. In addition, inasmuch as each of the first and the second fixed contacts 51A and 52A has the difference H' in level, it is possible to decrease the load energy upon driving of it in comparison with the conventional electromagnetic relay serving as the continuous contact. In addition, the seesaw type electromagnetic relay according to the third embodiment has the gentle load characteristic. As a result, there is much margin for a matching between the magnetic attraction force of the electromagnet and the urging force of the urging spring. The seesaw type electromagnetic relay according to the third embodiment consumes small power upon driving of it in comparison with the conventional electromagnetic relay serving as the continuous contact.

Although both of the first and the second fixed contacts have the difference in level in the above-mentioned third embodiment, only one of the first and the second fixed contacts may have the difference in level.

While this invention has far been described in conjunction with a few preferred embodiments thereof, it will now be readily possible for those skilled in the art to put this invention into practice in various other manner. For example, only one of a pair of spring sections in the movable spring may fork into two branches to form a pair of spring pieces. At any rate, a distance between one movable contact element of a twin movable contact and a fixed contact may be different from another distance between another movable contact element of the twin movable contact and the fixed contact in an open state.

What is claimed is:

1. A seesaw type electromagnetic relay comprising:

a support member;

an armature coupled to the support member and having a central part and a pair of armature arm parts extending from the central part in opposite directions, the armature lying in a plane and carrying out a seesaw motion in response to excitation of an electromagnet;

a movable spring having a middle part fixed to the supporting member and first and second spring sections extending from the middle part in opposite directions, the first and second spring sections each having a free end and a bottom surface, the first spring section forking into two branches at the free end to form a first spring branch and a second spring branch, the first spring branch lying in the plane, the second spring branch being bent downward with respect to the plane, the movable spring carrying out a seesaw motion in synchronism with the seesaw motion of said armature;

movable contacts mounted on the bottom surface at the free end of the second spring section and mounted on the bottom surface of the first and second spring branches of the first spring section, the movable contacts mounted at the first spring branch and the second spring branch forming a twin movable contact;

a housing;

first and second terminal strips mounted on the housing;

fixed contacts mounted on the second terminal strip facing the movable contacts of the second spring section and mounted on the first terminal strip facing the twin movable contact.

2. A seesaw type electromagnetic relay as claimed in claim 1, wherein the twin movable contact has a difference in level.

3. A seesaw type electromagnetic relay comprising:

a supporting member;

an armature rotatably supported by the supporting member, the armature comprising a central part and a pair of armature arm parts extending from the central part in opposite directions, the armature carrying out a seesaw motion in response to excitation of an electromagnet;

a movable spring comprising a middle part fixed to said supporting member and a pair of spring sections extending in parallel with the pair of armature arm parts, said movable spring having free end parts and a bottom surface, at least one of the spring sections forking into two branches to form a pair of spring pieces, said movable spring carrying out a seesaw motion in synchronism with the seesaw motion of said armature;

movable contacts mounted at the free end parts of said movable spring on the bottom surface of said movable spring, one of said movable contacts being mounted at the free end part in the spring pieces to form a pair of movable contact elements acting as a twin movable contact;

fixed contacts facing said movable contacts, one of said fixed contacts being opposed to the twin movable contact and comprising a twin fixed contact having a difference in level in an open state, thereby making said seesaw type electromagnetic relay serve as a continuous contact.

4. A spring contact for a relay comprising:

a spring body lying in a first plane, the spring body having a forked end;

a first branch of the forked end extending from said spring body and lying in the first plane, the first branch having a free end, an upper surface and a lower surface;

a first contact formed on the lower surface of the first branch at the free end of the first branch;

a second branch of the forked end extending from said spring body, the second branch lying in a second plane different from the first plane, the second branch having a free end, an upper surface and a lower surface; and a second contact formed on the lower surface of the second branch at the free end, the second contact being at a level below said first contact.

5. A spring contact for a relay comprising:

a middle section;

a first section extending from the middle section and having a first free end, the middle and first sections lying in a plane;

a second section having a forked free end and extending from the middle section in an opposite direction from the first section;

a first branch of the forked free end of the second section and lying in the first plane, the first branch having an upper surface and a lower surface;

a first contact formed on the lower surface of the first branch;

a second branch of the forked free end of the second section, the second branch lying in a second plane different from the first plane, the second branch having an upper surface and a lower surface; and a second contact formed the lower surface of the second branch, the second contact being disposed at a level below said first contact.

6. A seesaw type electromagnetic relay comprising:

an armature lying in a plane;

a movable spring coupled to the armature and having first and second spring sections lying in the plane, each of the first and second spring sections having a free end, at least the first spring section being forked at the first spring section free end to form a first branch and a second branch, the first branch lying in the plane, the second branch being bent downward with respect to the plane; and movable contacts formed at the free ends of the first and second spring sections.

* * * * *